US006180297B1

(12) United States Patent
Tam et al.

(10) Patent No.: US 6,180,297 B1
(45) Date of Patent: Jan. 30, 2001

(54) MIGRATION IMAGING PROCESS

(75) Inventors: Man C. Tam; Edward G. Zwartz, both of Mississauga (CA)

(73) Assignee: Xerox Corporation, Stamford, CT (US)

( * ) Notice: Under 35 U.S.C. 154(b), the term of this patent shall be extended for 0 days.

(21) Appl. No.: 08/432,291

(22) Filed: May 1, 1995

(51) Int. Cl.[7] ..... G03G 17/10
(52) U.S. Cl. ..... 430/41
(58) Field of Search ..... 430/41

(56) References Cited

U.S. PATENT DOCUMENTS

| | | | |
|---|---|---|---|
| 3,909,262 | 9/1975 | Goffe et al. | 430/41 |
| 4,536,457 | 8/1985 | Tam | 430/41 |
| 4,536,458 | 8/1985 | Ng | 430/41 |
| 5,102,756 | 4/1992 | Vincett et al. | 430/41 |
| 5,215,838 | 6/1993 | Tam et al. | 430/41 |

*Primary Examiner*—Roland Martin
(74) *Attorney, Agent, or Firm*—Judith L. Byorick

(57) ABSTRACT

Disclosed is a process which comprises (a) providing a migration imaging member comprising (1) a substrate, (2) an infrared or red light radiation sensitive layer comprising a pigment predominantly sensitive to infrared or red light radiation, and (3) a softenable layer comprising a softenable material, a charge transport material, and a photosensitive migration marking material predominantly sensitive to radiation at a wavelength other than that to which the infrared or red light sensitive pigment is predominantly sensitive; (b) uniformly charging the imaging member; (c) subsequent to step (b), uniformly exposing the charged imaging member to a source of activating radiation with a wavelength to which the migration marking material is sensitive, wherein a filter comprising the infrared or red light radiation sensitive pigment is situated between the radiation source and the imaging member; (d) subsequent to step (b), exposing the imaging member to infrared or red light radiation at a wavelength to which the infrared or red light radiation sensitive pigment is sensitive in an imagewise pattern, thereby forming an electrostatic latent image on the imaging member; and (e) subsequent to steps (c) and (d), causing the softenable material to soften, thereby enabling the migration marking material to migrate through the softenable material toward the substrate in an imagewise pattern.

32 Claims, 11 Drawing Sheets

MIGRATION IMAGING PROCESS

BACKGROUND OF THE INVENTION

The present invention is directed to a migration imaging process. More specifically, the present invention is directed to a migration imaging process in which one of the exposure steps entails the use of radiation of a specifically controlled wavelength. One embodiment of the present invention is directed to a process which comprises (a) providing a migration imaging member comprising (1) a substrate, (2) an infrared or red light radiation sensitive layer comprising a pigment predominantly sensitive to infrared or red light radiation, and (3) a softenable layer comprising a softenable material, a charge transport material, and a photosensitive migration marking material predominantly sensitive to radiation at a wavelength other than that to which the infrared or red light sensitive pigment is predominantly sensitive; (b) uniformly charging the imaging member; (c) subsequent to step (b), uniformly exposing the charged imaging member to a source of activating radiation with a wavelength to which the migration marking material is sensitive, wherein a filter comprising the infrared or red light radiation sensitive pigment is situated between the radiation source and the imaging member; (d) subsequent to step (b), exposing the imaging member to infrared or red light radiation at a wavelength to which the infrared or red light radiation sensitive pigment is sensitive in an imagewise pattern, thereby forming an electrostatic latent image on the imaging member; and (e) subsequent to steps (c) and (d), causing the softenable material to soften, thereby enabling the migration marking material to migrate through the softenable material toward the substrate in an imagewise pattern.

Migration imaging systems capable of producing high quality images of high optical contrast density and high resolution have been developed. Such migration imaging systems are disclosed in, for example, U.S. Pat. Nos. 5,215,838, 5,202,206, 5,102,756, 5,021,308, 4,970,130, 4,937,163, 4,883,731, 4,880,715, 4,853,307, 4,536,458, 4,536,457, 4,496,642, 4,482,622, 4,281,050, 4,252,890, 4,241,156, 4,230,782, 4,157,259, 4,135,926, 4,123,283, 4,102,682, 4,101,321, 4,084,966, 4,081,273, 4,078,923, 4,072,517, 4,065,307, 4,062,680, 5,055,418, 4,040,826, 4,029,502, 4,028,101, 4,014,695, 4,013,462, 4,012,250, 4,009,028, 4,007,042, 3,998,635, 3,985,560, 3,982,939, 3,982,936, 3,979,210, 3,976,483, 3,975,739, 3,975,195, and 3,909,262, the disclosures of each of which are totally incorporated herein by reference, and in "Migration Imaging Mechanisms, Exploitation, and Future Prospects of Unique Photographic Technologies, XDM and AMEN", P. S. Vincett, G. J. Kovacs, M. C. Tam, A. L. Pundsack, and P. H. Soden, *Journal of Imaging Science* 30 (4) July/August, pp. 183–191 (1986), the disclosure of which is totally incorporated herein by reference.

The expression "softenable" as used herein is intended to mean any material which can be rendered more permeable, thereby enabling particles to migrate through its bulk. Conventionally, changing the permeability of such material or reducing its resistance to migration of migration marking material is accomplished by dissolving, swelling, melting, or softening, by techniques, for example, such as contacting with heat, vapors, partial solvents, solvent vapors, solvents, and combinations thereof, or by otherwise reducing the viscosity of the softenable material by any suitable means.

The expression "fracturable" layer or material as used herein means any layer or material which is capable of breaking up during development, thereby permitting portions of the layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers can be substantially or wholly embedded in the softenable layer in various embodiments of the imaging members.

The expression "contiguous" as used herein is intended to mean in actual contact, touching, also, near, though not in contact, and adjoining, and is intended to describe generically the relationship of the fracturable layer of marking material in the softenable layer with the surface of the softenable layer spaced apart from the substrate.

The expression "optically sign-retained" as used herein is intended to mean that the dark (higher optical density) and light (lower optical density) areas of the visible image formed on the migration imaging member correspond to the dark and light areas of the illuminating electromagnetic radiation pattern.

The expression "optically sign-reversed" as used herein is intended to mean that the dark areas of the image formed on the migration imaging member correspond to the light areas of the illuminating electromagnetic radiation pattern and the light areas of the image formed on the migration imaging member correspond to the dark areas of the illuminating electromagnetic radiation pattern.

The expression "optical contrast density" as used herein is intended to mean the difference between maximum optical density ($D_{max}$) and minimum optical density ($D_{min}$) of an image. Optical density is measured for the purpose of this invention by diffuse densitometers with a blue Wratten No. 47 filter. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all values of transmission optical density given in this invention include the substrate density of about 0.2 which is the typical density of a metallized polyester substrate.

High optical density in migration imaging members allows high contrast densities in migration images made from the migration imaging members. High contrast density is highly desirable for most information storage systems. Contrast density is used herein to denote the difference between maximum and minimum optical density in a migration image. The maximum optical density value of an imaged migration imaging member is, of course, the same value as the optical density of an unimaged migration imaging member.

There are various other systems for forming such images, wherein non-photosensitive or inert marking materials are arranged in the aforementioned fracturable layers, or dispersed throughout the softenable layer, as described in the aforementioned patents, which also disclose a variety of methods which can be used to form latent images upon migration imaging members.

Various means for developing the latent images can be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore, the image sense of the developed image is optically sign reversed. Various methods and materials and combinations thereof have previously been used to fix such unfixed migration images. One method is to overcoat the image with a transparent abrasion resistant polymer by solution coating techniques. In the heat or vapor softening developing modes, the migration marking material in the light struck region disperses in the depth of the softenable layer after development and this region exhibits $D_{min}$ which is typically in the range of 0.6 to 0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8 to 1.9. Therefore, the image sense of the heat or vapor developed images is optically sign-retained.

Techniques have been devised to permit optically sign-reversed imaging with vapor development, but these techniques are generally complex and require critically controlled processing conditions. An example of such techniques can be found in U.S. Pat. No. 3,795,512, the disclosure of which is totally incorporated herein by reference.

For many imaging applications, it is desirable to produce negative images from a positive original or positive images from a negative original (optically sign-reversing imaging), preferably with low minimum optical density. Although the meniscus or solvent wash away development method produces optically sign-reversed images with low minimum optical density, it entails removal of materials from the migration imaging member, leaving the migration image largely or totally unprotected from abrasion. Although various methods and materials have previously been used to overcoat such unfixed migration images, the post-development overcoating step can be impractically costly and inconvenient for the end users. Additionally, disposal of the effluents washed from the migration imaging member during development can also be very costly.

The background portions of an imaged member can sometimes be transparentized by means of an agglomeration and coalescence effect. In this system, an imaging member comprising a softenable layer containing a fracturabie layer of electrically photosensitive migration marking material is imaged in one process mode by electrostatically charging the member, exposing the member to an imagewise pattern of activating electromagnetic radiation, and softening the softenable layer by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85 to 90 percent of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25 to 0.35 range. Thus, the contrast density of the final image is typically in the range of 0.35 to 0.65. Alternatively, the migration image can be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the coalesced particles towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the imaging member and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262, the disclosure of which is totally incorporated herein by reference. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles, and the like, application of an overcoat to the softenable layer can cause changes in the delicate balance of these processes and result in degraded photographic characteristics compared with the non-overcoated migration imaging member. Notably, the photographic contrast density can degraded. Recently, improvements in migration imaging members and processes for forming images on these migration imaging members have been achieved. These improved migration imaging members and processes are described in U.S. Pat. No. 4,536,458 and U.S. Pat. No. 4,536,457.

Migration imaging members are also suitable for use as masks for exposing the photosensitive material in a printing plate. The migration imaging member can be laid on the plate prior to exposure to radiation, or the migration imaging member layers can be coated or laminated onto the printing plate itself prior to exposure to radiation, and removed subsequent to exposure.

U.S. Pat. No. 5,102,756 (Vincett et al.), the disclosure of which is totally incorporated herein by reference, discloses a printing plate precursor which comprises a base layer, a layer of photohardenable material, and a layer of softenable material containing photosensitive migration marking material. Alternatively, the precursor can comprise a base layer and a layer of softenable photohardenable material containing photosensitive migration marking material. Also disclosed are processes for preparing printing plates from the disclosed precursors.

U.S. Pat. No. 5,215,838 (Tam et al.), the disclosure of which is totally incorporated herein by reference, discloses a migration imaging member comprising a substrate, an infrared or red light radiation sensitive layer comprising a pigment predominantly sensitive to infrared or red light radiation, and a softenable layer comprising a softenable material, a charge transport material, and migration marking material predominantly sensitive to radiation at a wavelength other than that to which the infrared or red light radiation sensitive pigment is sensitive contained at or near the surface of the softenable layer. When the migration imaging member is imaged and developed, it is particularly suitable for use as a xeroprinting master and can also be used for viewing or for storing data.

Copending application U.S. Ser. No. 08/413,667, filed Mar. 30, 1995, entitled "improved Apparatus and Process for Preparation of Migration Imaging Members," with the named inventors Philip H. Soden and Arnold L. Pundsack, the disclosure of which is totally incorporated herein by reference, discloses an apparatus for evaporation of a vacuum evaporatable material onto a substrate, said apparatus comprising (a) a walled container for the vacuum evaporatable material having a plurality of apertures in a surface thereof, said apertures being configured so that the vacuum evaporatable material is uniformly deposited onto the substrate; and (b) a source of heat sufficient to effect evaporation of the vacuum evaporatable material from the container through the apertures onto the substrate, wherein the surface of the container having the plurality of apertures therein is maintained at a temperature equal to or greater than the temperature of the vacuum evaporatable material.

While known apparatus and processes are suitable for their intended purposes, a need remains for improved processes for imaging infrared or red light sensitive migration imaging members. There is also a need for processes for imaging infrared or red light sensitive migration imaging members wherein the infrared or red light sensitive pigment absorbs little or no radiation at the wavelength employed to expose the migration marking material. Further, there is a need for processes for imaging infrared or red light sensitive migration imaging members wherein the radiation employed to expose the migration marking material does not cause discharge of the latent image in the infrared or red light sensitive layer. Additionally, a need remains for processes for imaging infrared or red light sensitive migration imaging members which can be performed with conventional imaging apparatus and conventional, inexpensive light sources. There is also a need for processes for imaging infrared or red light sensitive migration imaging members which can be carried out simply and at low cost.

SUMMARY OF THE INVENTION

It is an object of the present invention to provide migration imaging processes with the above noted advantages.

It is another object of the present invention to provide improved processes for imaging infrared or red light sensitive migration imaging members.

It is yet another object of the present invention to provide processes for imaging infrared or red light sensitive migration imaging members wherein the infrared or red light sensitive pigment absorbs little or no radiation at the wavelength employed to expose the migration marking material.

It is still another object of the present invention to provide processes for imaging infrared or red light sensitive migration imaging members wherein the radiation employed to expose the migration marking material does not cause discharge of the latent image in the infrared or red light sensitive layer.

Another object of the present invention is to provide processes for imaging infrared or red light sensitive migration imaging members which can be performed with conventional imaging apparatus and conventional, inexpensive light sources.

Yet another object of the present invention is to provide processes for imaging infrared or red light sensitive migration imaging members which can be carried out simply and at low cost.

These and other objects of the present invention (or specific embodiments thereof) can be achieved by providing a process which comprises (a) providing a migration imaging member comprising (1) a substrate, (2) an infrared or red light radiation sensitive layer comprising a pigment predominantly sensitive to infrared or red light radiation, and (3) a softenable layer comprising a softenable material, a charge transport material, and a photosensitive migration marking material predominantly sensitive to radiation at a wavelength other than that to which the infrared or red light sensitive pigment is predominantly sensitive; (b) uniformly charging the imaging member; (c) subsequent to step (b), uniformly exposing the charged imaging member to a source of activating radiation with a wavelength to which the migration marking material is sensitive, wherein a filter comprising the infrared or red light radiation sensitive pigment is situated between the radiation source and the imaging member; (d) subsequent to step (b), exposing the imaging member to infrared or red light radiation at a wavelength to which the infrared or red light radiation sensitive pigment is sensitive in an imagewise pattern, thereby forming an electrostatic latent image on the imaging member; and (e) subsequent to steps (c) and (d), causing the softenable material to soften, thereby enabling the migration marking material to migrate through the softenable material toward the substrate in an imagewise pattern.

DETAILED DESCRIPTION OF THE INVENTION

The present invention encompasses a process wherein an infrared or red light sensitive migration imaging member is exposed in an imagewise pattern to infrared or red light radiation and is also uniformly exposed to radiation at another wavelength through a filter containing the same infrared or red light sensitive pigment employed in the infrared or red light sensitive layer of the migration imaging member.

Figure 1:
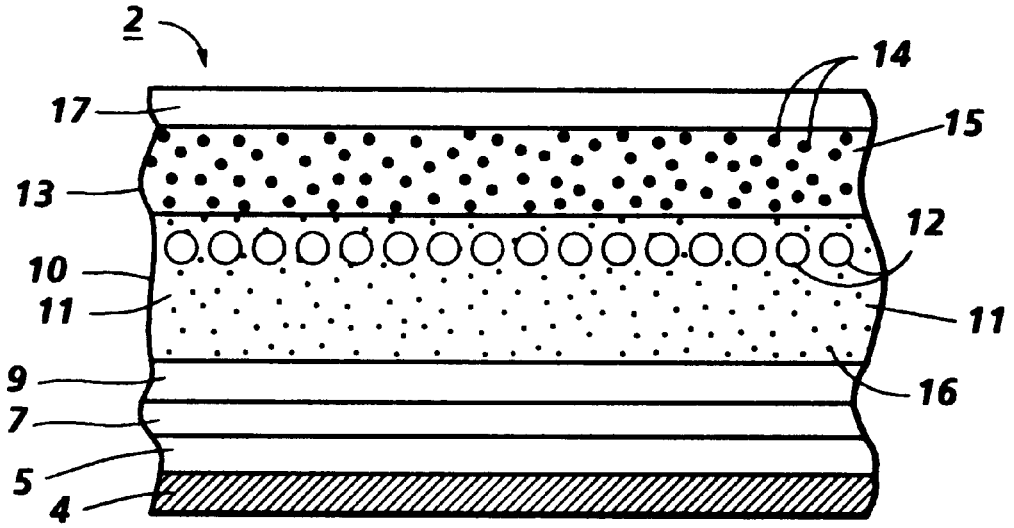
FIG. 1 illustrates schematically a migration imaging member suitable for the present invention.

An example of a migration imaging member suitable for the present invention is illustrated schematically in FIG. 1. As illustrated schematically in FIG. 1, migration imaging member 2 comprises in the order shown a substrate 4, an optional adhesive layer 5 situated on substrate 4, an optional charge blocking layer 7 situated on optional adhesive layer 5, an optional charge transport layer 9 situated on optional charge blocking layer 7, a softenable layer 10 situated on optional charge transport layer 9, said softenable layer 10 comprising softenable material 11, charge transport material 16, and migration marking material 12 situated at or near the surface of the softenable layer spaced from the substrate, and an infrared or red light radiation sensitive layer 13 situated on softenable layer 10 comprising infrared or red light radiation sensitive pigment particles 14 optionally dispersed in polymeric binder 15. Alternatively (not shown), infrared or red light radiation sensitive layer 13 can comprise infrared or red light radiation sensitive pigment particles 14 directly deposited as a layer by, for example, vacuum evaporation techniques or other coating methods. Optional overcoating layer 17 is situated on the surface of imaging member 2 spaced from the substrate 4. Any or all of the optional layers and materials can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

Figure 2:
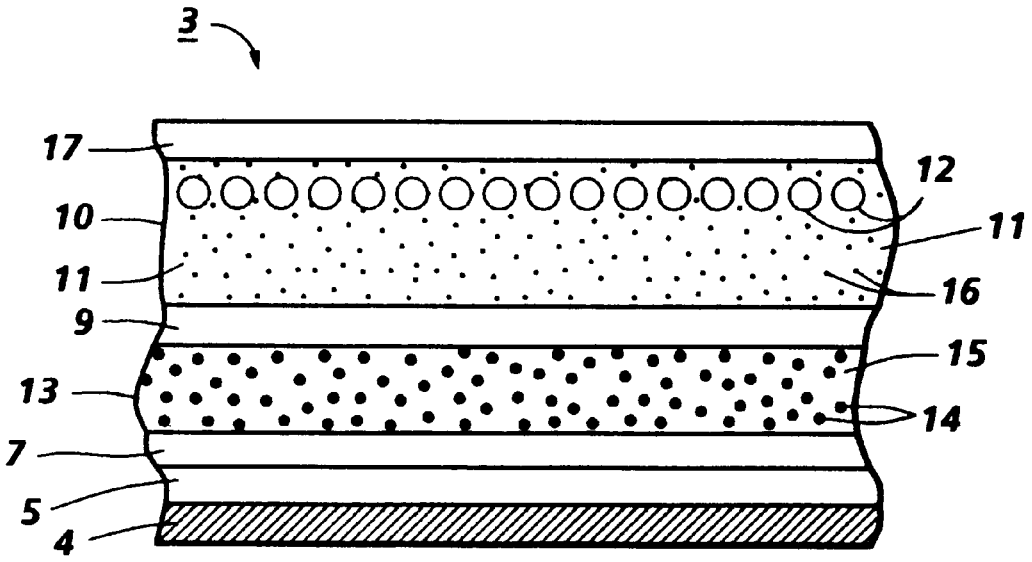
FIG. 2 illustrates schematically another migration imaging member suitable for the present invention.

Another example of a migration imaging member suitable for the present invention is illustrated schematically in FIG. 2. As illustrated schematically in FIG. 2, migration imaging member 3 comprises in the order shown a substrate 4, an optional adhesive layer 5 situated on substrate 4, an optional charge blocking layer 7 situated on optional adhesive layer 5, an infrared or red light radiation sensitive layer 13 situated on optional charge blocking layer 7 comprising infrared or red light radiation sensitive pigment particles 14 optionally dispersed in polymeric binder 15, an optional charge transport layer 9 situated on infrared or red light radiation sensitive layer 13, a softenable layer 10 situated on optional charge transport layer 9, said softenable layer 10 comprising softenable material 11, charge transport material 16, and migration marking material 12 situated at or near the surface of the softenable layer spaced from the substrate. Optional overcoating layer 17 is situated on the surface of imaging member 3 spaced from the substrate 4. Any or all of the optional layers and materials can be absent from the imaging member. In addition, any of the optional layers present need not be in the order shown, but can be in any suitable arrangement. The migration imaging member can be in any suitable configuration, such as a web, a foil, a laminate, a strip, a sheet, a coil, a cylinder, a drum, an endless belt, an endless mobius strip, a circular disc, or any other suitable form.

The substrate can be either electrically conductive or electrically insulating. When conductive, the substrate can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. When insulative, the substrate can be opaque, translucent, semitransparent, or transparent, and can be of any suitable insulative material, such as paper, glass, plastic, polyesters such as Mylar® (available from Du Pont) or Melinex® 442 (available from ICI Americas, Inc.), and the like. In addition, the substrate can comprise an insulative layer with a conductive coating, such as vacuum-deposited metallized plastic, such as titanized or aluminized Mylar® polyester, wherein the metallized surface is in contact with the softenable layer or any other layer situated between the substrate and the softenable layer. The substrate has any effective thickness, typically from about 6 to about 250 microns, and preferably from about 50 to about 200 microns, although the thickness can be outside these ranges.

The softenable layer can comprise one or more layers of softenable materials, which can be any suitable material, typically a plastic or thermoplastic material which is soluble in a solvent or softenable, for example, in a solvent liquid, solvent vapor, heat, or any combinations thereof. When the softenable layer is to be softened or dissolved either during or after imaging, it should be soluble in a solvent that does not attack the migration marking material. By softenable is meant any material that can be rendered by a development step as described herein permeable to migration material migrating through its bulk. This permeability typically is achieved by a development step entailing dissolving, melting, or softening by contact with heat, vapors, partial solvents, as well as combinations thereof. Examples of suitable softenable materials include styrene-acrylic copolymers, such as styrene-hexylmethacrylate copolymers, styrene acrylate copolymers, styrene butylmethacrylate copolymers, styrene butylacrylate ethylacrylate copolymers, styrene ethylacrylate acrylic acid copolymers, and the like, polystyrenes, including polyalphamethyl styrene, alkyd substituted polystyrenes, styrene-olefin copolymers, styrene-vinyltoluene copolymers, polyesters, polyurethanes, polycarbonates, polyterpenes, silicone elastomers, mixtures thereof, copolymers thereof, and the like, as well as any other suitable materials as disclosed, for example, in U.S. Pat. No. 3,975,195 and other U.S. patents directed to migration imaging members which have been incorporated herein by reference. The softenable layer can be of any effective thickness, typically from about 1 to about 30 microns, preferably from about 2 to about 25 microns, and more preferably from about 2 to about 10 microns, although the thickness can be outside these ranges. The softenable layer can be applied to the conductive layer by any suitable coating process. Typical coating processes include draw bar coating, spray coating, extrusion, dip coating, gravure roll coating, wire-wound rod coating, air knife coating and the like.

The softenable layer also contains migration marking material. The migration marking material can be electrically photosensitive, photoconductive, or of any other suitable combination of materials, or possess any other desired physical property and still be suitable for use in the migration imaging members of the present invention. The migration marking materials preferably are particulate, wherein the particles are closely spaced from each other. Preferred migration marking materials generally are spherical in shape and submicron in size. The migration marking material generally is capable of substantial photodischarge upon electrostatic charging and exposure to activating radiation and is substantially absorbing and opaque to activating radiation in the spectral region where the photosensitive migration marking particles photogenerate charges. The migration marking material is generally present as a thin layer or monolayer of particles situated at or near the surface of the softenable layer spaced from the conductive layer. When present as particles, the particles of migration marking material preferably have an average diameter of up to 2 microns, and more preferably of from about 0.1 to about 1 micron. The layer of migration marking particles is situated at or near that surface of the softenable layer spaced from or most distant from the conductive layer. Preferably, the particles are situated at a distance of from about 0.01 to 0.1 micron from the layer surface, and more preferably from about 0.02 to 0.08 micron from the layer surface. Preferably, the particles are situated at a distance of from about 0.005 to about 0.2 micron from each other, and more preferably at a distance of from about 0.05 to about 0.1 micron from each other, the distance being measured between the closest edges of the particles, i.e. from outer diameter to outer diameter. The migration marking material contiguous to the outer surface of the softenable layer is present in any effective amount, preferably from about 5 to about 80 percent by total weight of the softenable layer, and more preferably from about 25 to about 80 percent by total weight of the softenable layer, although the amount can be outside of this range.

Examples of suitable migration marking materials include selenium, alloys of selenium with alloying components such as tellurium, arsenic, antimony, thallium, bismuth, or mixtures thereof, selenium and alloys of selenium doped with halogens, as disclosed in, for example, U.S. Pat. No. 3,312,548, the disclosure of which is totally incorporated herein by reference, and the like, phthalocyanines, and any other suitable materials as disclosed, for example, in U.S. Pat. No. 3,975,195 and other U.S. patents directed to migration imaging members and incorporated herein by reference.

If desired, two or more softenable layers, each containing migration marking particles, can be present in the imaging member as disclosed in copending application U.S. Ser. No. 08/353,461, filed Dec. 9, 1994, entitled "Improved Migration Imaging Members," with the named inventors Edward G. Zwartz, Carol A. Jennings, Man C. Tam, Philip H. Soden, Arthur Y. Jones, Arnold L. Pundsack, Enrique Levy, Ah-Mee Hor, and William W. Limburg, the disclosure of which is totally incorporated herein by reference.

The softenable layer of the migration imaging member contains a charge transport material. The charge transport material can be any suitable charge transport material either capable of acting as a softenable layer material or capable of being dissolved or dispersed on a molecular scale in the softenable layer material. When a charge transport material is also contained in another layer in the imaging member, preferably there is continuous transport of charge through the entire film structure. The charge transport material is defined as a material which is capable of improving the charge injection process for one sign of charge from the migration marking material into the softenable layer and also of transporting that charge through the softenable layer. The charge transport material can be either a hole transport material (transports positive charges) or an electron transport material (transports negative charges). The sign of the charge used to sensitize the migration imaging member during imaging can be of either polarity. Charge transporting materials are well known in the art. Typical charge transporting materials include the following:

Diamine transport molecules of the type described in U.S. Pat. No. 4,306,008, U.S. Pat. No. 4,304,829, U.S. Pat. No. 4,233,384, U.S. Pat. No. 4,115,116, U.S. Pat. No. 4,299,897, and U.S. Pat. No. 4,081,274, the disclosures of each of which are totally incorporated herein by reference. Typical diamine transport molecules include N,N'-diphenyl-N,N'-bis(3"-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851, the disclosures of each of which are totally incorporated herein by reference. Typical pyrazoline transport molecules include 1-(lepidyl-(2)1-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl) pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene,2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Patent 1,058,836, German Patent 1,060,260, and German Patent 1,120,875, the disclosures of each of which are totally incorporated herein by reference.

Hydrazone transport molecules, such as p-diethylamino benzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone, and the like. Other typical hydrazone transport molecules are described, for example in U.S. Pat. No. 4,150,987, U.S. Pat. No. 4,385,106, U.S. Pat. No. 4,338,388, and U.S. Pat. No. 4,387,147, the disclosures of each of which are totally incorporated herein by reference.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. No. 4,256,821 and U.S. Pat. No. 4,297,426, the disclosures of each of which are totally incorporated herein by reference.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717, the disclosure of which is totally incorporated herein by reference.

Oxadiazole derivatives such as 2,5-bis-(p-diethylaminophenyl)-oxadiazole-1,3,4 described in U.S. Pat. No. 3,895,944, the disclosure of which is totally incorporated herein by reference.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989, the disclosure of which is totally incorporated herein by reference.

9-Fluorenylidene methane derivatives having the formula

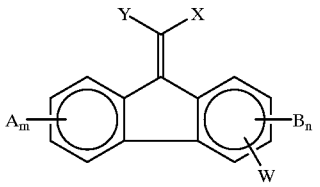

wherein X and Y are cyano groups or alkoxycarbonyl groups; A, B, and W are electron withdrawing groups independently selected from the group consisting of acyl, alkoxycarbonyl, nitro, alkylaminocarbonyl, and derivatives thereof; m is a number of from 0 to 2; and n is the number 0 or 1 as described in U.S. Pat. No. 4,474,865, the disclosure of which is totally incorporated herein by reference. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene) malonontrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole, 3,6-dibromo-poly-N-vinyl carbazole, and numerous other transparent organic polymeric or non-polymeric transport materials as described in U.S. Pat. No. 3,870,516, the disclosure of which is totally incorporated herein by reference. Also suitable as charge transport materials are phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toluene, 4,6-dichloro-1, 3-dinitrobenzene, 4,6-dibromo-1,3-dinitrobenzene, P-dinitrobenzene, chloranil, bromanil, and mixtures thereof, 2,4,7-trinitro-9-fluorenone, 2,4,5,7-tetranitrofluorenone, trinitroanthracene, dinitroacridene, tetracyanopyrene, dinitroanthraquinone, polymers having aromatic or heterocyclic groups with more than one strongly electron withdrawing substituent such as nitro, sulfonate, carboxyl, cyano, or the like, including polyesters, polysiloxanes, polyamides, polyurethanes, and epoxies, as well as block, graft, or random copolymers containing the aromatic moiety, and the like, as well as mixtures thereof, as described in U.S. Pat. No. 4,081,274, the disclosure of which is totally incorporated herein by reference.

Also suitable are charge transport materials such as triarylamines, including tritolyl amine, of the formula

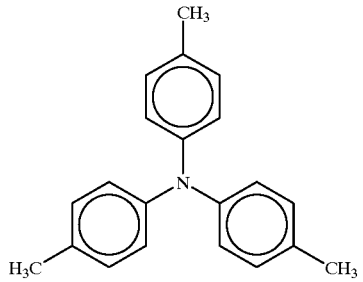

and the like, as disclosed in, for example, U.S. Pat. No. 3,240,597 and U.S. Pat. No. 3,180,730, the disclosures of which are totally incorporated herein by reference, and substituted diarylmethane and triarylmethane compounds, including bis-(4-diethylamino-2-methylphenyl)-phenylmethane, of the formula

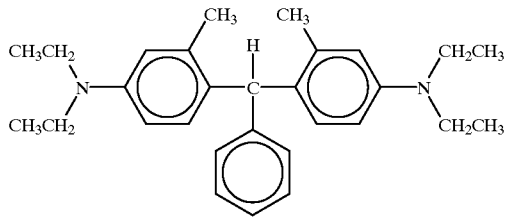

and the like, as disclosed in, for example, U.S. Pat. No. 4,082,551, U.S. Pat. No. 3,755,310, U.S. Pat. No. 3,647,431, British Patent 984,965, British Patent 980,879, and British Patent 1,141,666, the disclosures of which are totally incorporated herein by reference.

When the charge transport molecules are combined with an insulating binder to form the softenable layer, the amount of charge transport molecule which is used can vary depending upon the particular charge transport material and its compatibility (e.g. solubility) in the continuous insulating film forming binder phase of the softenable matrix layer and the like. Satisfactory results have been obtained using between about 5 percent to about 50 percent by weight charge transport molecule based on the total weight of the softenable layer. A particularly preferred charge transport molecule is one having the general formula

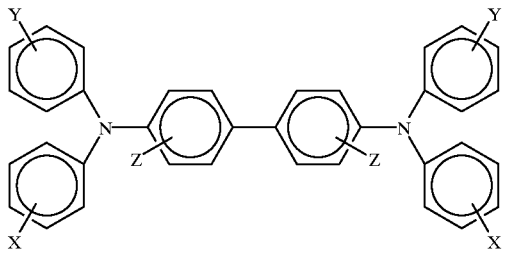

wherein X, Y and Z are selected from the group consisting of hydrogen, an alkyl group having from 1 to about 20 carbon atoms and chlorine, and at least one of X, Y and Z is independently selected to be an alkyl group having from 1 to about 20 carbon atoms or chlorine. If Y and Z are hydrogen, the compound can be named N,N'-diphenyl-N,N'-bis(alkylphenyl)-[1,1'-biphenyl]-4,4'-diamine wherein the alkyl is, for example, methyl, ethyl, propyl, n-butyl, or the like, or the compound can be N,N'-diphenyl-N,N'-bis(chlorophenyl)-[1,1'-biphenyl]-4,4'-diamine. Results can be obtained when the softenable layer contains between about 8 percent to about 40 percent by weight of these diamine compounds based on the total weight of the softenable layer. Optimum results are achieved when the softenable layer contains between about 16 percent to about 32 percent by weight of N,N'-diphenyl-N,N'-bis(3"-methylphenyl)-(1,1'-biphenyl)-4,4'-diamine based on the total weight of the softenable layer.

The charge transport material is present in the softenable material in any effective amount, typically from about 5 to about 50 percent by weight and preferably from about 8 to about 40 percent by weight, although the amount can be outside these ranges. Alternatively, the softenable layer can employ the charge transport material as the softenable material if the charge transport material possesses the necessary film-forming characteristics and otherwise functions as a softenable material. The charge transport material can be incorporated into the softenable layer by any suitable technique. For example, it can be mixed with the softenable layer components by dissolution in a common solvent. If desired, a mixture of solvents for the charge transport material and the softenable layer material can be employed to facilitate mixing and coating. The charge transport molecule and softenable layer mixture can be applied to the substrate by any conventional coating process. Typical coating processes include draw bar coating, spray coating, extrusion, dip coating, gravure roll coating, wire-wound rod coating, air knife coating, and the like.

The optional adhesive layer can include any suitable adhesive material. Typical adhesive materials include copolymers of styrene and an acrylate, polyester resin such as DuPont 49000 (available from E.I. duPont de Nemours Company), copolymer of acrylonitrile and vinylidene chloride, polyvinyl acetate, polyvinyl butyral and the like and mixtures thereof. The adhesive layer can have any thickness, typically from about 0.05 to about 1 micron, although the thickness can be outside of this range. When an adhesive layer is employed, it preferably forms a uniform and continuous layer having a thickness of about 0.5 micron or less to ensure satisfactory discharge during the imaging process. It can also optionally include charge transport molecules.

The optional charge transport layer can comprise any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, an 80/20 mole percent copolymer of styrene and hexylmethacrylate having an intrinsic viscosity of 0.179 dl/gm; other copolymers of styrene and hexylmethacrylate, styrene-vinyltoluene copolymers, polyalpha-methylstyrene, mixtures thereof, and copolymers thereof. The above group of materials is not intended to be limiting, but merely illustrative of materials suitable as film forming binder materials in the optional charge transport layer. The film forming binder material typically is substantially electrically insulating and does not adversely chemically react during the imaging process. Although the optional charge transport layer has been described as coated on a substrate, in some embodiments, the charge transport layer itself can have sufficient strength and integrity to be substantially self supporting and can, if desired, be brought into contact with a suitable conductive substrate during the imaging process. As is well known in the art, a uniform deposit of electrostatic charge of suitable polarity can be substituted for a conductive layer. Alternatively, a uniform deposit of electrostatic charge of suitable polarity on the exposed surface of the charge transport spacing layer can be substituted for a conductive layer to facilitate the application of electrical migration forces to the migration layer. This technique of "double charging" is well known in the art. The charge transport layer is of any effective thickness, typically from about 1 to about 25 microns, and preferably from about 2 to about 20 microns, although the thickness can be outside these ranges.

Charge transport molecules suitable for the charge transport layer are described in detail hereinabove. The specific charge transport molecule utilized in the charge transport layer of any given imaging member can be identical to or different from the charge transport molecule employed in the adjacent softenable layer. Similarly, the concentration of the charge transport molecule utilized in the charge transport spacing layer of any given imaging member can be identical to or different from the concentration of charge transport molecule employed in the adjacent softenable layer. When the charge transport material and film forming binder are combined to form the charge transport spacing layer, the amount of charge transport material used can vary depending upon the particular charge transport material and its compatibility (e.g. solubility) in the continuous insulating film forming binder. Satisfactory results have been obtained using between about 5 percent and about 50 percent based on the total weight of the optional charge transport spacing layer, although the amount can be outside this range. The charge transport material can be incorporated into the charge transport layer by techniques similar to those employed for the softenable layer.

The optional charge blocking layer can be of various suitable materials, provided that the objectives of the present invention are achieved, including aluminum oxide, polyvinyl butyral, silane and the like, as well as mixtures thereof. This layer, which is generally applied by known coating techniques, is of any effective thickness, typically from about 0.05 to about 1 micron, and preferably from about 0.05 to about 0.5 micron. Typical coating processes include draw bar coating, spray coating, extrusion, dip coating, gravure roll coating, wire-wound rod coating, air knife coating and the like.

The infrared or red light sensitive layer generally comprises a pigment sensitive to infrared and/or red light radiation. While the infrared or red light sensitive pigment may exhibit some photosensitivity in the wavelength to which the migration marking material is sensitive, it is preferred that photosensitivity in this wavelength range be minimized so that the migration marking material and the infrared or red light sensitive pigment exhibit absorption peaks in distinct, different wavelength regions. This pigment can be deposited as the sole or major component of the infrared or red light sensitive layer by any suitable technique, such as vacuum evaporation or the like. An infrared or red light sensitive layer of this type can be formed by placing the pigment and the imaging member comprising the substrate and any previously coated layers into an evacuated chamber, followed by heating the infrared or red light sensitive pigment to the point of sublimation. The sublimed material recondenses to form a solid film on the imaging member. Alternatively, the infrared or red light sensitive pigment can be dispersed in a polymeric binder and the dispersion coated onto the imaging member to form a layer. Examples of suitable red light sensitive pigments include perylene pigments such as benzimidazole perylene, dibromoanthranthrone, crystalline trigonal selenium, beta-metal free phthalocyanine, azo pigments, and the like, as well as mixtures thereof. Examples of suitable infrared sensitive pigments include X-metal free phthalocyanine, metal phthalocyanines such as vanadyl phthalocyanine, chloroindium phthalocyanine, titanyl phthalocyanine, chloroaluminum phthalocyanine, copper phthalocyanine, magnesium phthalocyanine, and the like, squaraines, such as hydroxy squaraine, and the like as well as mixtures thereof. Examples of suitable optional polymeric binder materials include polystyrene, styrene-acrylic copolymers, such as styrene-hexylmethacrylate copolymers, styrene-vinyl toluene copolymers, polyesters, such as PE-200, available from Goodyear, polyurethanes, polyvinylcarbazoles, epoxy resins, phenoxy resins, polyamide resins, polycarbonates, polyterpenes, silicone elastomers, polyvinylalcohols, such as Gelvatol 20-90, 9000, 20-60, 6000, 20-30, 3000, 40-20, 40-10, 26-90, and 30-30, available from Monsanto Plastics and Resins Co., St. Louis, Mo., polyvinylformals, such as Formvar 12/85, 5/95E, 6/95E, 7/95E, and 15/95E, available from Monsanto Plastics and Resins Co., St. Louis, Mo., polyvinylbutyrals, such as Butvar B-72, B-74, B-73, B-76, B-79, B-90, and B-98, available from Monsanto Plastics and Resins Co., St. Louis, Mo., Zeneca resin A622, available from Zeneca Colours, Wilmington, Del., and the like as well as mixtures thereof. When the infrared or red light sensitive layer comprises both a polymeric binder and the pigment, the layer typically comprises the binder in an amount of from about 5 to about 95 percent by weight and the pigment in an amount of from about 5 to about 95 percent by weight, although the relative amounts can be outside this range. Preferably, the infrared or red light sensitive layer comprises the binder in an amount of from about 40 to about 90 percent by weight and the pigment in an amount of from about 10 to about 60 percent by weight. Optionally, the infrared sensitive layer can contain a charge transport material as described herein when a binder is present; when present, the charge transport material is generally contained in this layer in an amount of from about 5 to about 30 percent by weight of the layer. The optional charge transport material can be incorporated into the infrared or red light radiation sensitive layer by any suitable technique. For example, it can be mixed with the infrared or red light radiation sensitive layer components by dissolution in a common solvent. If desired, a mixture of solvents for the charge transport material and the infrared or red light sensitive layer material can be employed to facilitate mixing and coating. The infrared or red light radiation sensitive layer mixture can be applied to the substrate by any conventional coating process. Typical coating processes include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. When the infrared or red light sensitive layer is coated directly onto the softenable layer containing migration marking material, preferably the selected solvent is capable of dissolving the polymeric binder for the infrared or red sensitive layer but does not dissolve the softenable polymer in the layer containing the migration marking material. One example of a suitable solvent is isobutanol with a polyvinyl butyral binder in the infrared or red sensitive layer and a styrene/ethyl acrylate/acrylic acid terpolymer softenable material in the layer containing migration marking material. The infrared or red light sensitive layer can be of any effective thickness. Typical thicknesses for infrared or red light sensitive layers comprising a pigment and a binder are from about 0.05 to about 2 microns, and preferably from about 0.1 to about 1.5 microns, although the thickness can be outside these ranges. Typical thicknesses for infrared or red light sensitive layers consisting of a vacuum-deposited layer of pigment are from about 200 to about 2,000 Angstroms, and preferably from about 300 to about 1,000 Angstroms, although the thickness can be outside these ranges.

The optional overcoating layer can be substantially electrically insulating, or have any other suitable properties. The overcoating preferably is substantially transparent, at least in the spectral region where electromagnetic radiation is used for imagewise exposure steps in the imaging process. The overcoating layer is continuous and preferably of a thickness up to about 3 microns. More preferably, the overcoating has a thickness of between about 0.5 and about 2 microns to minimize residual charge buildup. Overcoating layers greater than about 3 microns thick can also be used. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer generally protects the softenable layer to provide greater resistance to the adverse effects of abrasion during handling and imaging. The overcoating layer preferably adheres strongly to the softenable layer to minimize damage. The overcoating layer can also have abhesive properties at its outer surface which provide improved resistance to toner filming during toning, transfer, and/or cleaning. The abhesive properties can be inherent in the overcoating layer or can be imparted to the overcoating layer by incorporation of another layer or component of abhesive material. These abhesive materials should not degrade the film forming components of the overcoating and preferably have a surface energy of less than about 20 ergs/cm$^2$. Typical abhesive materials include fatty acids, salts and esters, fluorocarbons, silicones, and the like. The coatings can be applied by any suitable technique such as draw bar, spray, dip, melt, extrusion or gravure coating. It will be appreciated that these overcoating layers protect the imaging member before imaging, during imaging, and after the members have been imaged.

Figure 3A:
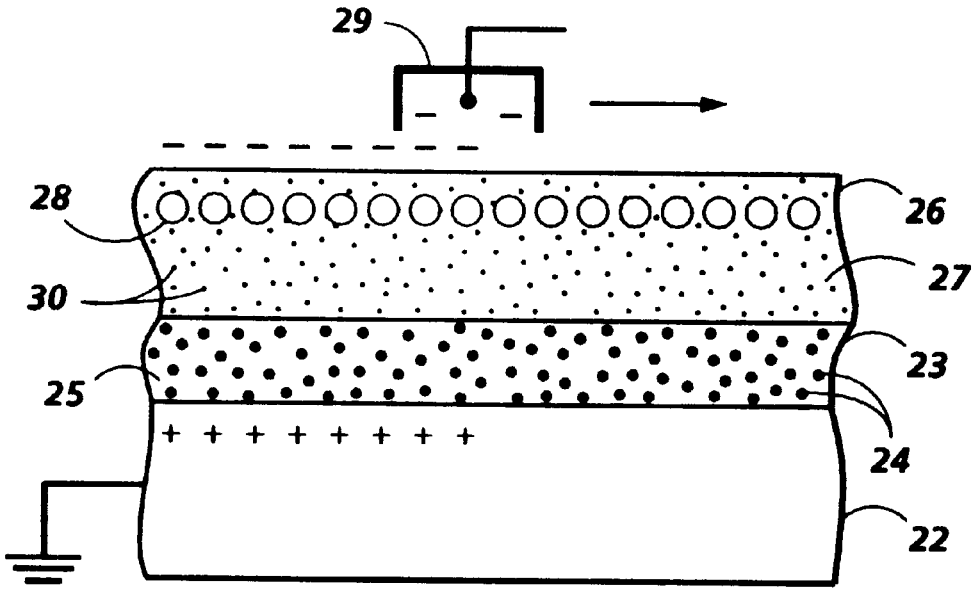
FIGS. 3A, 3B, 4A, 4B, 5A, 5B, 5C, 6A, 6B, 7A, 7B, 7C, 8A, and 8B illustrate schematically processes for imaging and developing infrared or red-light sensitive migration imaging members according to the present invention.
Figure 3B:
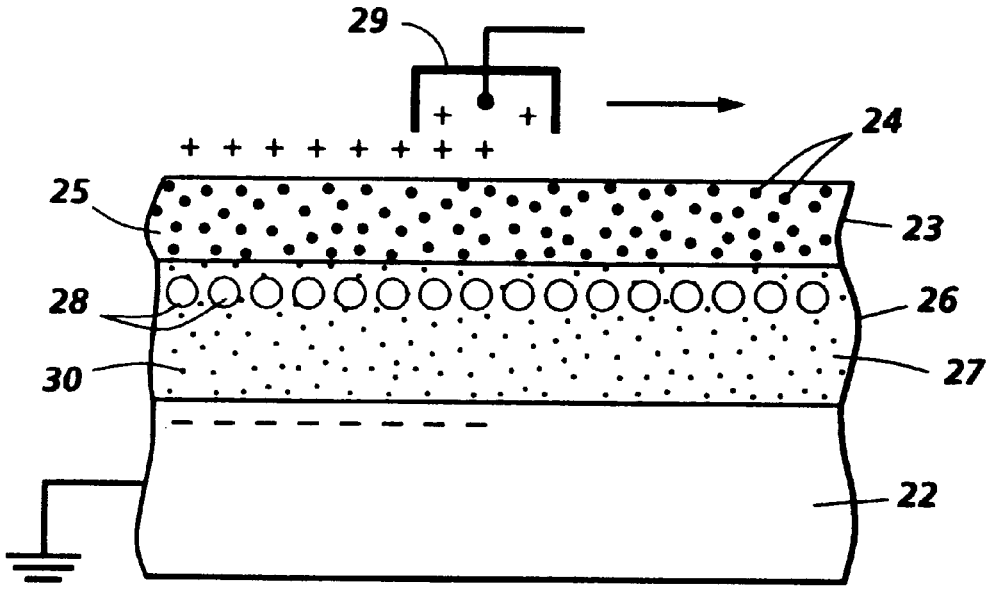

The process for imaging, developing, and overcoating an imaging member of the present invention as shown schematically in FIG. 1 or FIG. 2 by imagewise exposure to infrared or red radiation and developing a migration imaging member of the present invention is illustrated schematically in FIGS. 3A and 3B through 8A and 8B. The process illustrated schematically in FIGS. 3B, 4B, 5B, 5C, 6B, 7B, 7C, and 8B represents an embodiment of the present invention wherein the softenable layer is situated between the infrared or red light sensitive layer and the substrate and the softenable layer contains a charge transport material capable of transporting charges of one polarity. In the process steps illustrated in FIGS. 3B, 4B, 5B, 6B, and 7B, the imaging member is charged to the same polarity as that which the charge transport material in the softenable layer is capable of transporting; in the process steps illustrated schematically in FIGS. 5C and 7C, the imaging member is recharged to the polarity opposite to that which the charge transport material is capable of transporting. In FIGS. 3B, 4B, 5B, 5C, 6B, 7B, 7C, and 8B, the softenable material in the softenable layer contains a hole transport material (capable of transporting positive charges). FIGS. 3A and 3B through 8A and 8B illustrate schematically a migration imaging member comprising a conductive substrate layer 22 that is connected to a reference potential such as a ground, an infrared or red light sensitive layer 23 comprising infrared or red light sensitive pigment particles 24 dispersed in polymeric binder 25, and a softenable layer 26 comprising softenable material 27, migration marking material 28, and charge transport material 30. As illustrated in FIGS. 3A and B, the member is uniformly charged in the dark to either polarity (negative charging is illustrated in FIG. 3A, positive charging is illustrated in FIG. 3B) by a charging means 29 such as a corona charging apparatus.

Figure 4A:
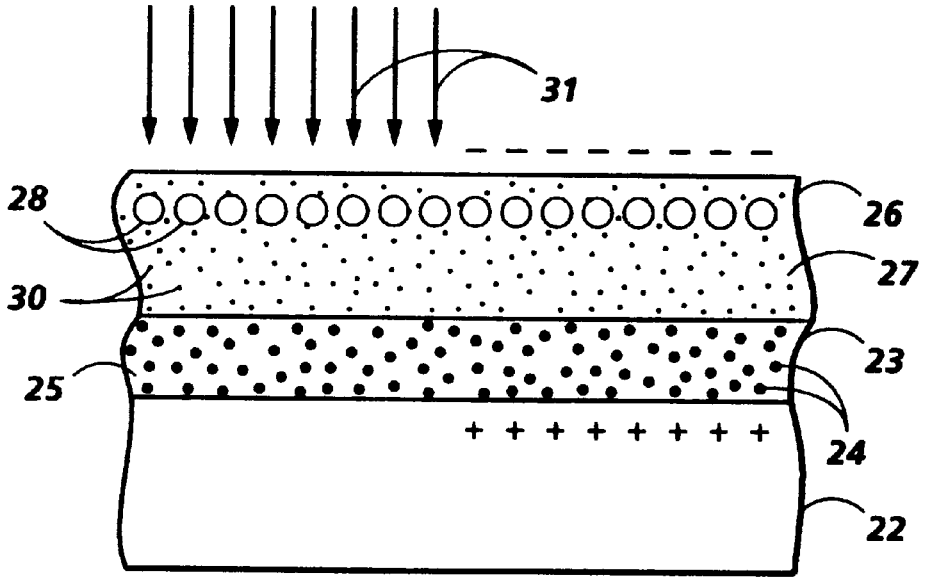
Figure 4B:
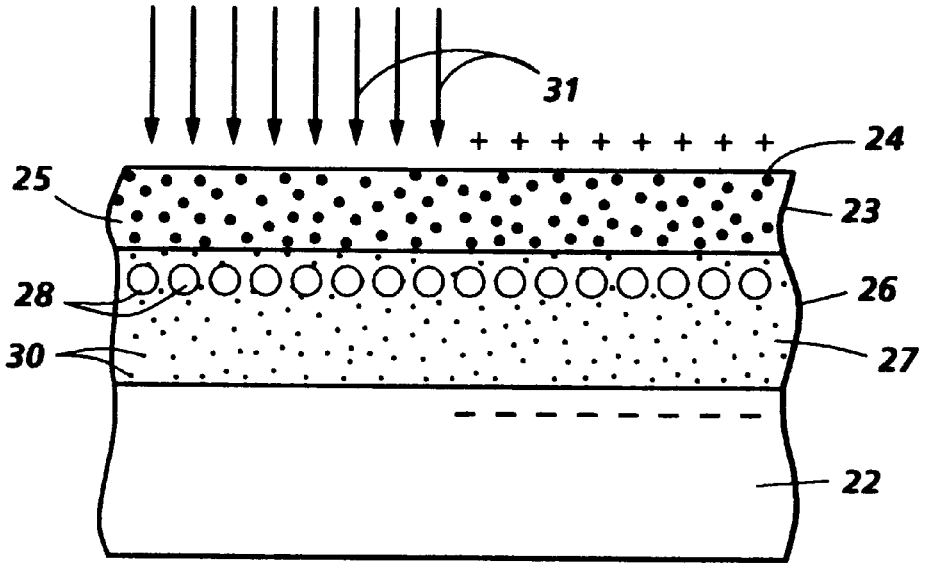

As illustrated schematically in FIGS. 4A and 4B, the charged member is first exposed imagewise to infrared or red light radiation 31. The wavelength of the infrared or red light radiation used is preferably selected to be in the region where the infrared or red-light sensitive pigments exhibit maximum optical absorption and maximum photosensitivity. When the softenable layer 26 is situated between the infrared or red light sensitive layer 23 and the radiation source 31, as shown in FIG. 4A, the infrared or red light radiation 31 passes through the non-absorbing migration marking material 28 (which is selected to be substantially insensitive to the infrared or red light radiation wavelength used in this step) and exposes the infrared or red light sensitive pigment particles 24 in the infrared or red light sensitive layer. Absorption of infrared or red light radiation by the infrared or red light sensitive pigment results in substantial photodischarge in the exposed areas. Thus the areas that are exposed to infrared radiation become substantially discharged. As shown in FIG. 4B, when the infrared or red light sensitive layer 23 is situated between the softenable layer 26 and the radiation source 31 and the member is charged to the same polarity as the charge transport material in the softenable layer is capable of transporting, absorption of infrared or red light radiation by the infrared or red light sensitive pigment results in substantial photodischarge in the exposed areas. Thus the areas that are exposed to infrared radiation become substantially discharged.

Figure 5A:
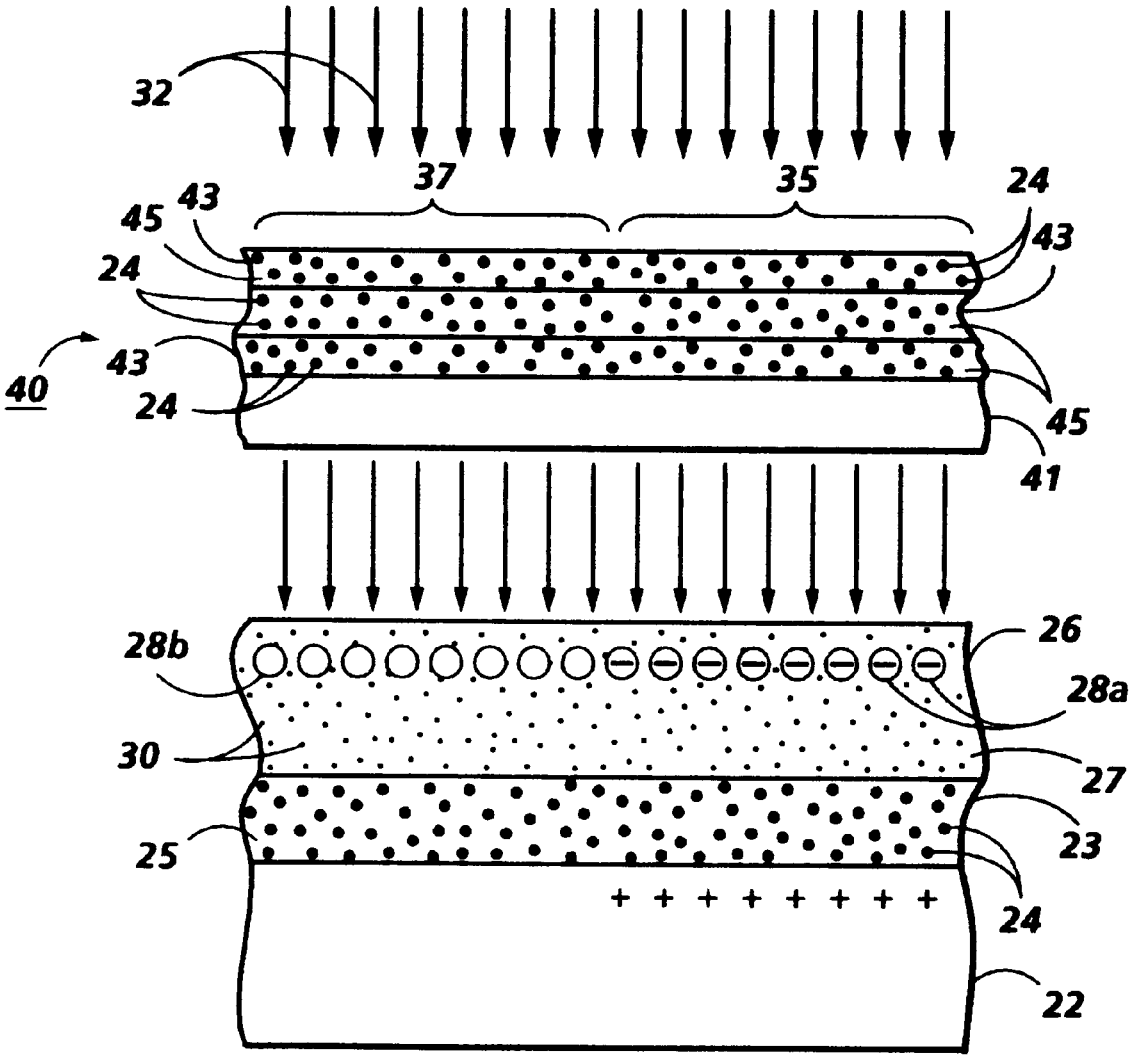
Figure 5B:
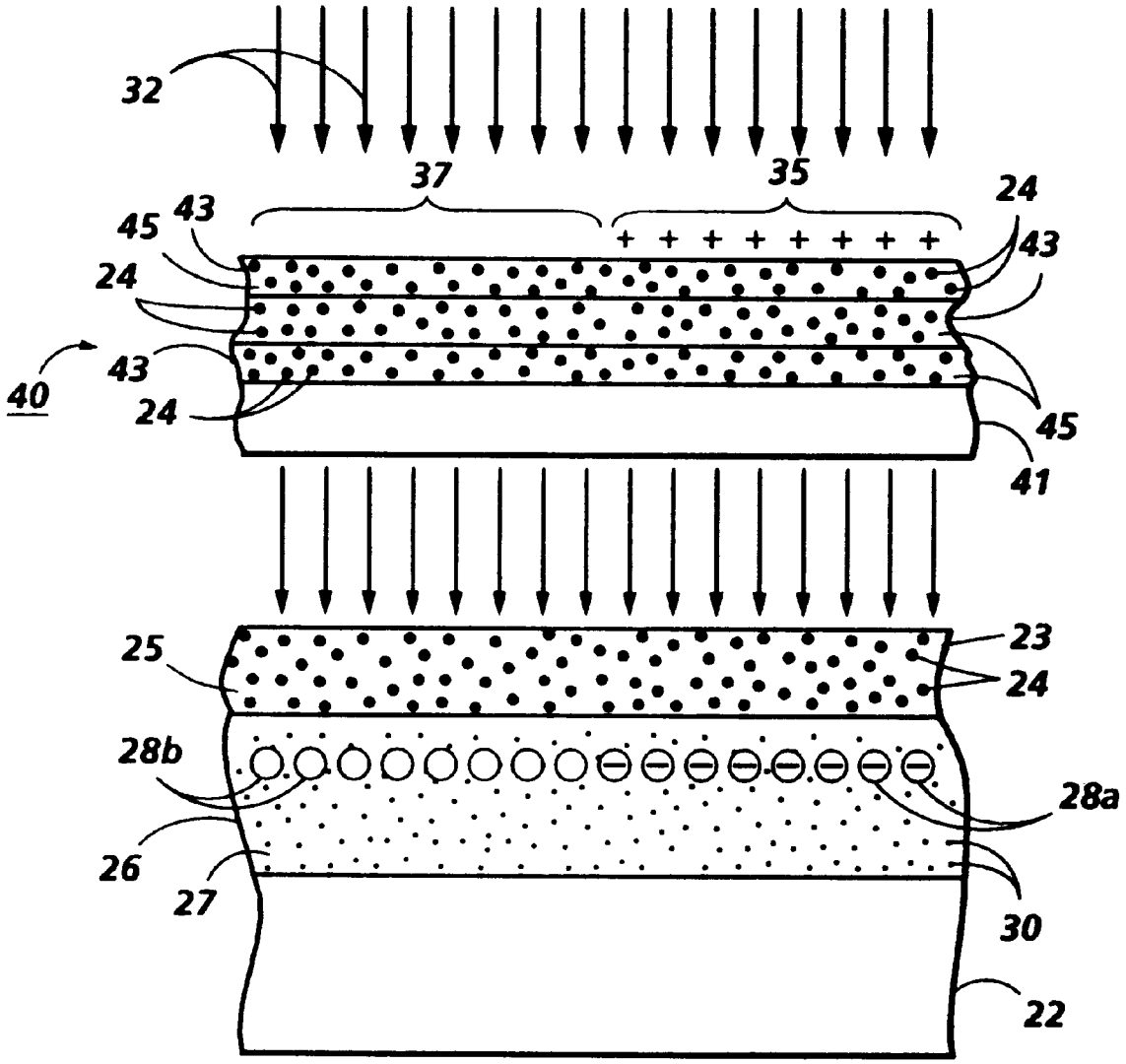

As illustrated schematically in FIGS. 5A and 5B, the charged member is subsequently exposed uniformly to activating radiation 32 at a wavelength to which the migration marking material 28 is sensitive. For example, when the migration marking material is selenium particles, blue or green light can be used for uniform exposure. As shown in FIG. 5A, when layer 26 is situated above layer 23, the uniform exposure to radiation 32 results in absorption of radiation by the migration marking material 28. (In the context of the present invention, "above" with respect to the ordering of the layers within the migration imaging member indicates that the layer is relatively nearer to the radiation source and relatively more distant from the substrate, and "below" with respect to the ordering of the layers within the migration imaging member indicates that the layer is relatively more distant from the radiation source and relatively nearer to the substrate.) In charged areas of the imaging member 35, the migration marking particles 28*a* acquire a negative charge as ejected holes (positive charges) discharge the surface charges, resulting in an electric field between the migration marking particles and the substrate. Areas 37 of the imaging member that have been substantially discharged by prior infrared or red light exposure are no longer sensitive, and the migration marking particles 28*b* in these areas acquire no or very little charge. As shown in FIG. 5B, when the infrared or red light sensitive layer 23 is situated above the softenable layer 26 and the member is charged to the same polarity as the charge transport material in the softenable layer is capable of transporting, uniform exposure to radiation 32 at a wavelength to which the migration marking material 28 is sensitive is largely absorbed by the migration marking material 28. The wavelength of the uniform light radiation is preferably selected to be in the region where the infrared or red-light sensitive pigments in layer 23 exhibit maximum light transmission and where the migration marking particles 28 exhibit maximum light absorption. Thus, in areas of the imaging member which are still charged, the migration marking particles 28*a* acquire a negative charge as ejected holes (positive charges) transport through the softenable layer to the substrate. Areas 37 of the imaging member that have been substantially discharged by prior infrared or red light exposure are no longer light sensitive, and the migration marking particles 28*b* in these areas acquire no or very little charge.

In the embodiments illustrated in FIGS. 5A and 5B, exposure is effected through filter 40, which is situated between the source of light radiation 32 and the migration imaging member. Filter 40 comprises optional substrate 41, which, if present, is of a material capable of transmitting light radiation at least at a wavelength to which the migration marking material is sensitive, and one or more layers 43 comprising infrared or red light sensitive pigment 24 and optional binder 45. Binder 45, if present, can be either the same as or different from optional binder 25 in the infrared or red light sensitive layer of the migration imaging member. Infrared or red light sensitive pigment 24 is the same material in both the migration imaging member and in layer or layers 43 of filter 40. The relative amounts of pigment 24 and optional binder 45 in layer or layers 43 can be either the same as or different from the relative amounts of pigment 24 and optional binder 25 in layer 23 of the imaging member, and one or both optional binders may be absent. Any effective or desired number of layers 43 can be employed in filter 40; a single layer can be employed, of any desired or effective thickness, or multiple layers of any desired thicknesses can be used. The effectiveness of the filter is determined by the maximum optical contrast density obtained with the imaged member. The optimum optical contrast density is found when the filter has a bandwith of the optical window ±50 nanometers centered on the optical window, more preferably ±40 nanometers, and even more preferably ±30 nanometers. At 50 nanometers above or below the center of the desired optical wavelength region, the filter preferably has at least about two times less transmission, more preferably at least about four times less transmission, and even more preferably at least about six times less transmission, than at the center of the desired optical wavelength region. For example, when the migration marking material is selenium, the infrared or red light sensitive pigment is X-metal-free phthalocyanine, the binder is ICI Neocryl A622 (a styrene-butyl methacrylate copolymer), the binder and pigment are present in relative amounts of 35 percent by weight pigment and 65 percent by weight binder, the layers are each 2 microns thick, and the substrate is plain polyester or aluminized polyester, excellent results can be obtained when 2 layers are employed. Any suitable material can be employed for optional substrate 41. Examples of suitable materials include those employed for the substrate 22 of the imaging member, such as polyester, aluminized or titanized polyester, or the like. The infrared or red light sensitive pigment 24 can be deposited as the sole or major component of layer or layers 43 on substrate 41 by any suitable technique, such as vacuum evaporation or the like. An infrared or red light sensitive layer of this type can be formed by placing the pigment and the substrate into an evacuated chamber, followed by heating the infrared or red light sensitive pigment to the point of sublimation. The sublimed material recondenses to form a solid film on the substrate. Alternatively, the infrared or red light sensitive pigment 24 can be dispersed in a polymeric binder 45 and the dispersion coated onto the substrate 41 to form a layer. When the infrared or red light sensitive layer or layers 43 comprise both a polymeric binder and the pigment, the layer typically comprises the binder in an amount of from about 5 to about 95 percent by weight and the pigment in an amount of from about 5 to about 95 percent by weight, although the relative amounts can be outside this range. Preferably, the infrared or red light sensitive layer or layers 43 comprise the binder in an amount of from about 40 to about 90 percent by weight and the pigment in an amount of from about 10 to about 60 percent by weight. The infrared or red light radiation sensitive layer mixture can be applied to the substrate by any conventional coating process. Typical coating processes include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. One example of a suitable solvent is isobutanol with a polyvinyl butyral binder. Slot die coating can be carried out under any desired circumstances, including (but not limited to) slots with widths of from about 12 to about 22 inches in width at coating speeds of from about 5 to about 15 feet per minute. Gravure coating can be carried out under any desired circumstances, including (but not limited to) gravure rolls of about 22 inches in width at coating speeds of from about 75 to about 150 feet per minute. The infrared or red light sensitive layer or layers 43 can be of any effective thickness. Typical thicknesses for infrared or red light sensitive layers 43 comprising a pigment and a binder are from about 0.5 to about 25 microns, and preferably from about 1 to about 20 microns, although the thickness can be outside these ranges. Typical thicknesses for infrared or red light sensitive layers consisting of a vacuum-deposited layer of pigment are from about 200 to about 3,000 Angstroms, and preferably from about 300 to about 2,500 Angstroms, although the thickness can be outside these ranges. The optical window of the pigment used for the filter generally has very low optical absorption. For example, the X-form of metal free phthalocyanine transmits over 95 percent of the light in the blue-green light wavelength region (about 490 namometers). The pigment window coincides with an absorbing region of selenium migration marking material. The bandwidth of the optical window ideally is about ±50 nm centered on the optical window, more preferably about ±40 nm, even more preferably about ±30 nm. At 50 nm above or below the center of the desired optical wavelength region the filter preferably has two times less transmission, more preferably four times less transmission, and even more preferably six times less transmission, than at the center of the desired optical wavelength range. The filter will produce the maximum optical contrast possible for the film.

Figure 5C:
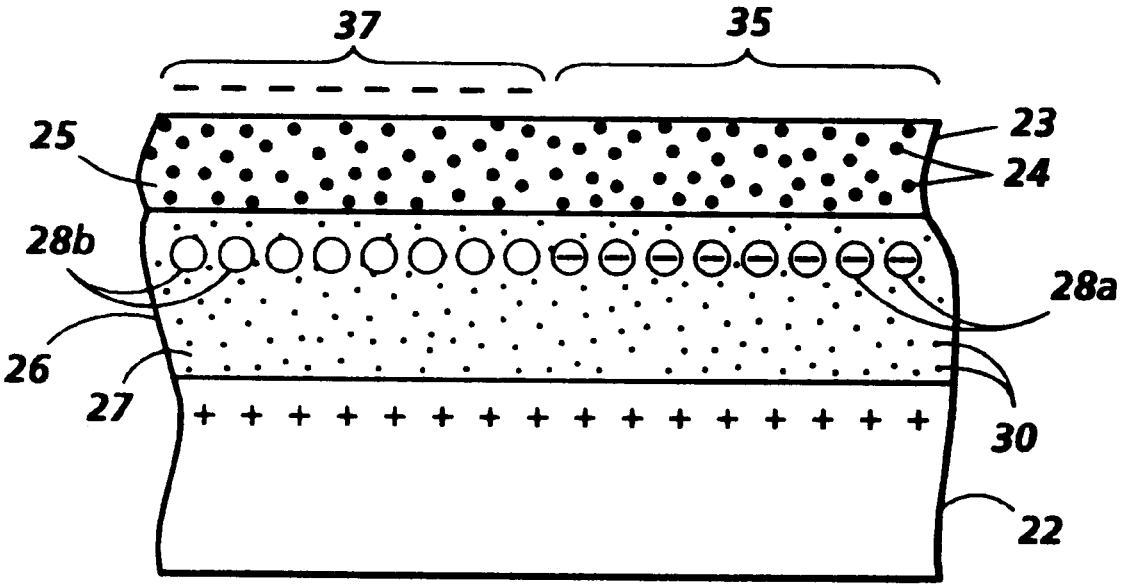

In the embodiment illustrated in FIG. 5B, the resulting charge pattern is such that the imaging member cannot be developed by heat development, since there is no substantial electric field between the migration marking materials and the substrate. As shown in FIG. 5C, the imaging member is further subjected to uniform recharging to a polarity opposite to that which the charge transport material in the softenable layer is capable of transporting (negative as illustrated in FIG. 5C), resulting in the migration marking material in areas of the imaging member which have not been exposed to infrared or red light radiation becoming negatively charged, with an electric field between the migration marking particles and the substrate, and areas of the imaging member previously exposed to infrared or red light radiation becoming charged only on the surface of the member.

It is important to emphasize that in general, the step of imagewise exposing the member to infrared or red light radiation and the step of uniformly exposing the member to radiation at a wavelength to which the migration marking material is sensitive can take place in any order. When the member is first imagewise exposed to infrared or red light radiation as illustrated in FIGS. 4A and 4B and subsequently uniformly exposed to radiation to which the migration marking material is sensitive as illustrated in FIGS. 5A, 5B, and 5C, the process proceeds as described with respect to FIGS. 4A, 4B, 5A, 5B, and 5C. When the member is first uniformly exposed to radiation to which the migration marking material is sensitive and subsequently imagewise exposed to infrared or red light radiation, the process proceeds as described with respect to FIGS. 6A, 6B, 7A, 7B, and 7C.

Figure 6A:
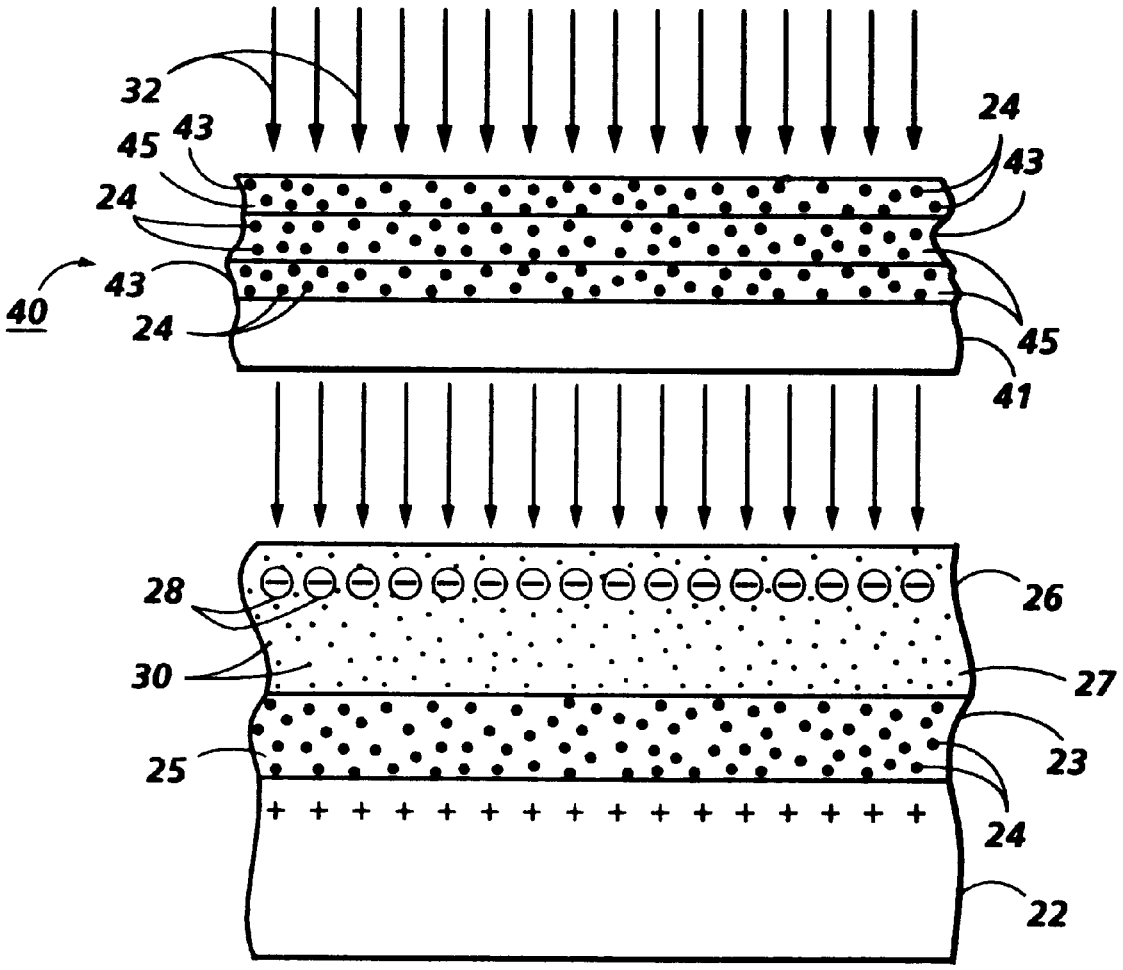
Figure 6B:
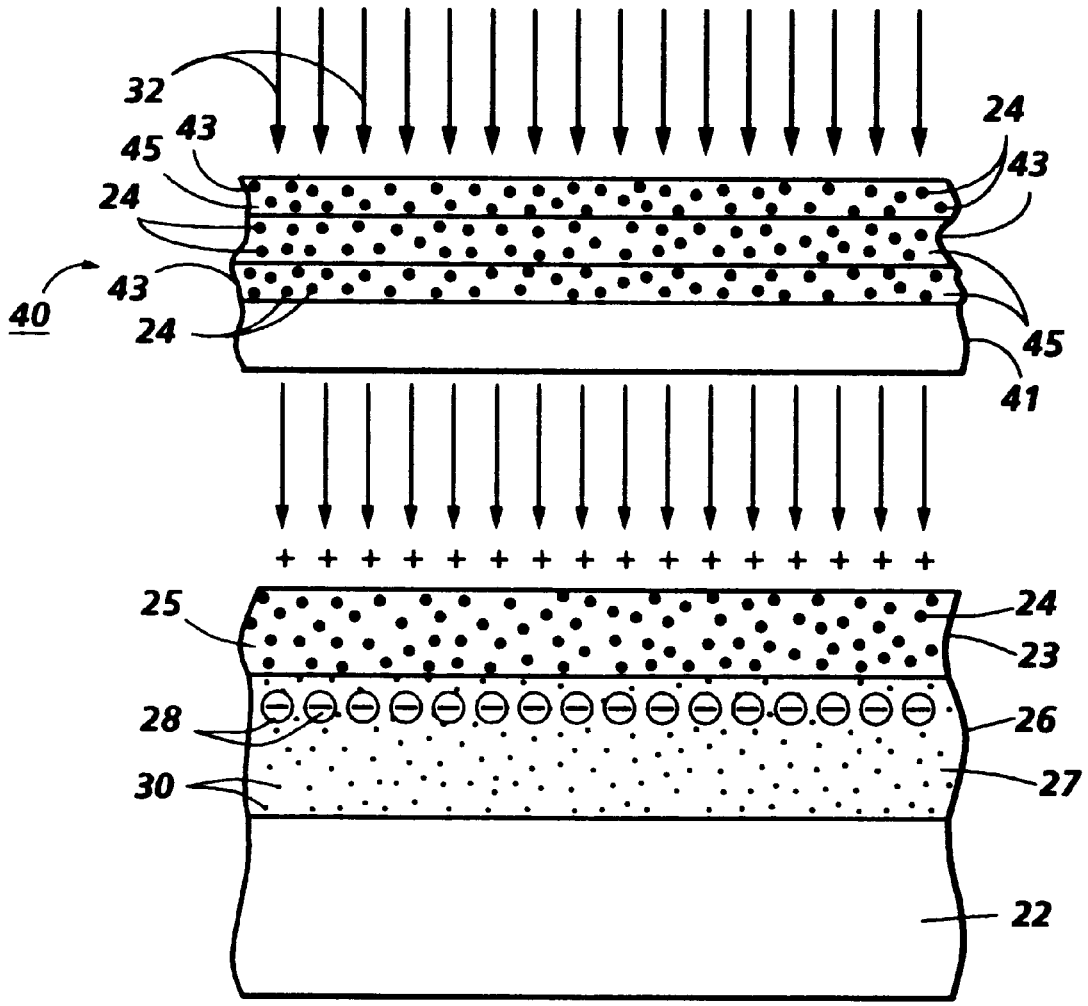

As illustrated schematically in FIGS. 6A and 6B, the charged member illustrated schematically in FIGS. 3A and 3B is first exposed uniformly to activating radiation 32 at a wavelength to which the migration marking material 28 is sensitive. For example, when the migration marking material is selenium particles, blue or green light can be used for uniform exposure. As shown in FIG. 6A, when layer 26 is situated above layer 23, the uniform exposure to radiation 32 results in absorption of radiation by the migration marking material 28. The migration marking particles 28 acquire a negative charge as ejected holes (positive charges) discharge the surface negative charges. As shown in FIG. 6B, when layer 23 is situated above layer 26, uniform exposure to activating radiation 32 at a wavelength to which the migration marking material is sensitive results in substantial photodischarge as the photogenerated charges (holes in this instance) in the migration marking particles are ejected out of the particles and transported to the substrate. As a result, the migration marking particles acquire a negative charge as shown schematically in FIG. 6B.

In the embodiments illustrated in FIGS. 6A and 6B, exposure is effected through filter 40, which is situated between the source of light radiation 32 and the migration imaging member. Filter 40 comprises optional substrate 41, which, if present, is of a material capable of transmitting light radiation at least at a wavelength to which the migration marking material is sensitive, and one or more layers 43 comprising infrared or red light sensitive pigment 24 and optional binder 45. Binder 45, if present, can be either the same as or different from optional binder 25 in the infrared or red light sensitive layer of the migration imaging member. Infrared or red light sensitive pigment 24 is the same material in both the migration imaging member and in layer or layers 43 of filter 40. The relative amounts of pigment 24 and optional binder 45 in layer or layers 43 can be either the same as or different from the relative amounts of pigment 24 and optional binder 25 in layer 23 of the imaging member, and one or both optional binders may be absent. Any effective or desired number of layers 43 can be employed in filter 40; a single layer can be employed, of any desired or effective thickness, or multiple layers of any desired thicknesses can be used. The effectiveness of the filter is determined by the maximum optical contrast density obtained with the imaged member. The optimum optical contrast density is found when the filter has a bandwith of the optical window ±50 nanometers centered on the optical window, more preferably ±40 nanometers, and even more preferably ±30 nanometers. At 50 nanometers above or below the center of the desired optical wavelength region, the filter preferably has at least about two times less transmission, more preferably at least about four times less transmission, and even more preferably at least about six times less transmission, than at the center of the desired optical wavelength region. For example, when the migration marking material is selenium, the infrared or red light sensitive pigment is X-metal-free plithalocyanine, the binder is ICI Neocryl A622 (a styrene-butyl methacrylate copolymer), the binder and pigment are present in relative amounts of 35 percent by weight pigment and 65 percent by weight binder, the layers are each 2 microns thick, and the substrate is plain polyester or aluminized polyester, excellent results can be obtained when 2 layers are employed. Any suitable material can be employed for optional substrate 41. Examples of suitable materials include those employed for the substrate 22 of the imaging member, such as polyester, aluminized or titanized polyester, or the like. The infrared or red light sensitive pigment 24 can be deposited as the sole or major component of layer or layers 43 on substrate 41 by any suitable technique, such as vacuum evaporation or the like. An infrared or red light sensitive layer of this type can be formed by placing the pigment and the substrate into an evacuated chamber, followed by heating the infrared or red light sensitive pigment to the point of sublimation. The sublimed material recondenses to form a solid film on the substrate. Alternatively, the infrared or red light sensitive pigment 24 can be dispersed in a polymeric binder 45 and the dispersion coated onto the substrate 41 to form a layer. When the infrared or red light sensitive layer or layers 43 comprise both a polymeric binder and the pigment, the layer typically comprises the binder in an amount of from about 5 to about 95 percent by weight and the pigment in an amount of from about 5 to about 95 percent by weight, although the relative amounts can be outside this range. Preferably, the infrared or red light sensitive layer or layers 43 comprise the binder in an amount of from about 40 to about 90 percent by weight and the pigment in an amount of from about 10 to about 60 percent by weight. The infrared or red light radiation sensitive layer mixture can be applied to the substrate by any conventional coating process. Typical coating processes include draw bar coating, spray coating, extrusion, dip coating, gravure roll coating, wire-wound rod coating, air knife coating, and the like. An infrared or red light sensitive layer wherein the pigment is present in a binder can be prepared by dissolving the polymer binder in a suitable solvent, dispersing the pigment in the solution by ball milling, coating the dispersion onto the imaging member comprising the substrate and any previously coated layers, and evaporating the solvent to form a solid film. One example of a suitable solvent is isobutanol with a polyvinyl butyral binder. The infrared or red light sensitive layer or layers 43 can be of any effective thickness. Typical thicknesses for infrared or red light sensitive layers 43 comprising a pigment and a binder are from about 0.5 to about 25 microns, and preferably from about 1 to about 20 microns, although the thickness can be outside these ranges. Typical thicknesses for infrared or red light sensitive layers consisting of a vacuum-deposited layer of pigment are from about 200 to about 3,000 Angstroms, and preferably from about 300 to about 2,500 Angstroms, although the thickness can be outside these ranges. The optical window of the pigment used for the filter generally has very low optical absorption. For example, the X-form of metal free phthalocyanine transmits over 95 percent of the light in the blue-green light wavelength region (about 490 namometers). The pigment window coincides with an absorbing region of selenium migration marking material. The bandwidth of the optical window ideally is about ±50 nm centered on the optical window, more preferably about ±40 nm, even more preferably about ±30 nm. At 50 nm above or below the center of the desired optical wavelength region the filter preferably has two times less transmission, more preferably four times less transmission, and even more preferably six times less transmission, than at the center of the desired optical wavelength range. The filter will produce the maximum optical contrast possible for the film.

Figure 7A:
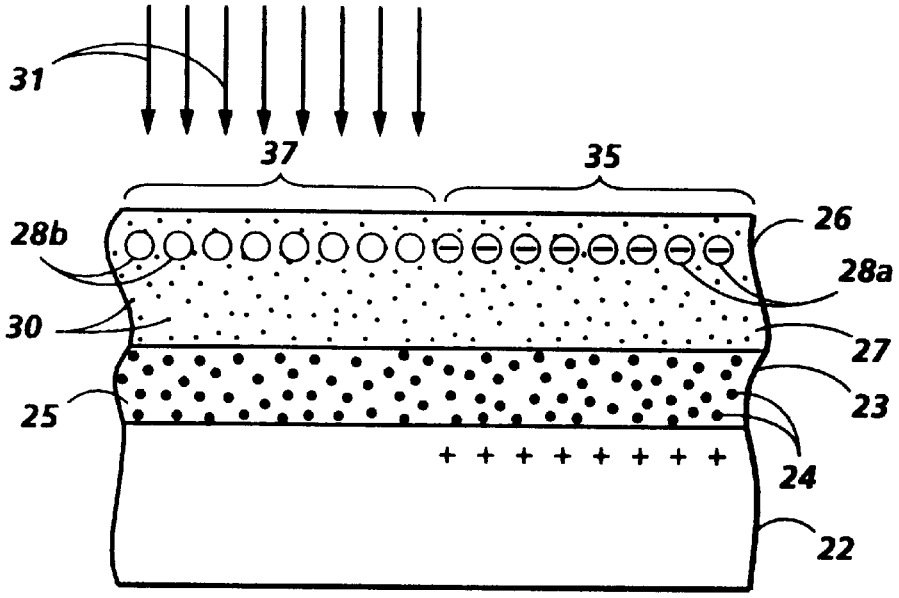
Figure 7B:
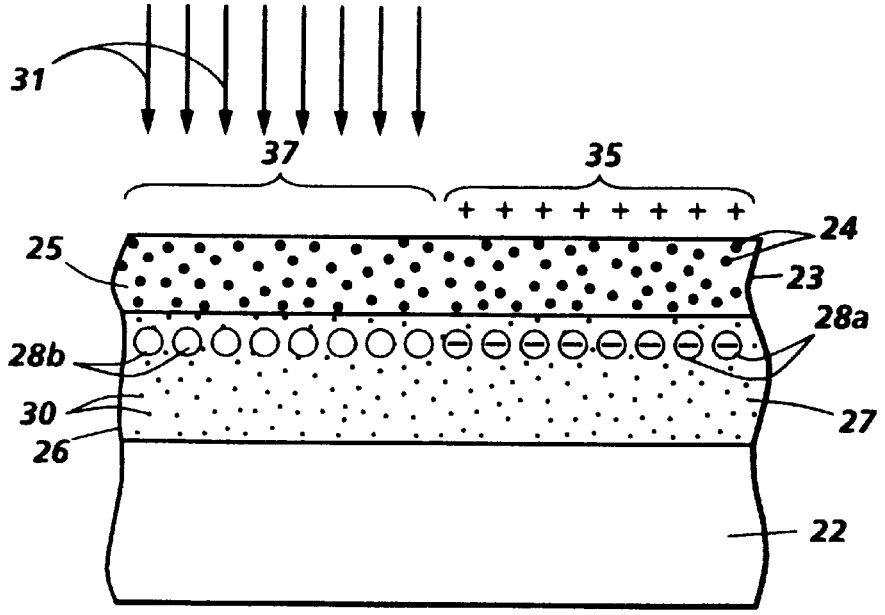
Figure 7C:
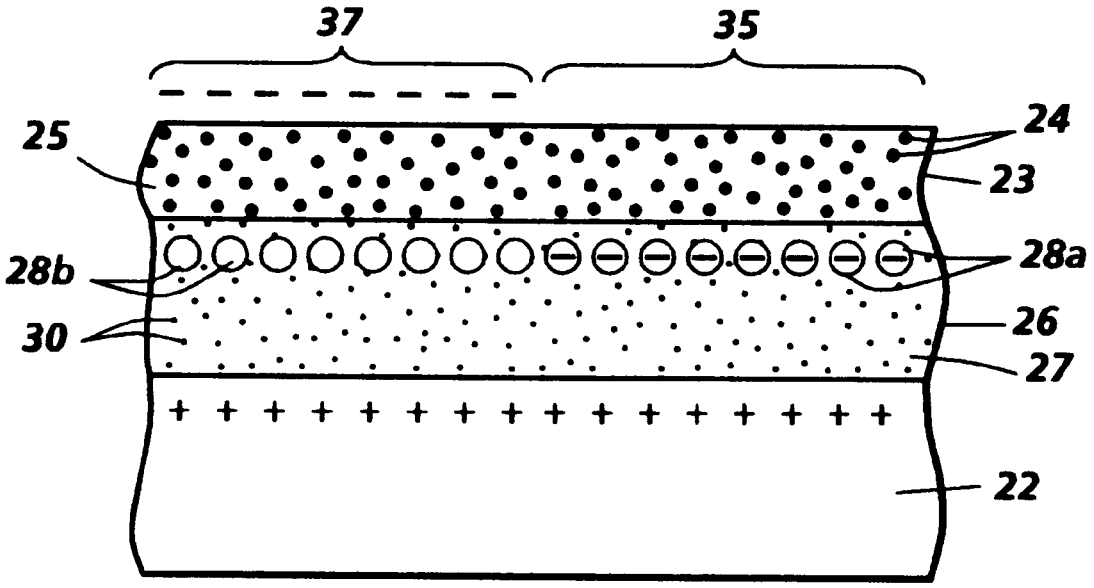

As illustrated schematically in FIGS. 7A, 7B, and 7C, the charged member is subsequently exposed imagewise to infrared or red light radiation 31. As shown in FIG. 7A, when the softenable layer 26 is situated between the infrared or red light sensitive layer 23 and the radiation source 31, the infrared or red light radiation 31 passes through the non-absorbing migration marking material 28 (which is selected to be insensitive to the infrared or red light radiation wavelength used in this step) and exposes the infrared or red light sensitive pigment particles 24 in the infrared or red light sensitive layer, thereby discharging the migration marking particles 28*b* in area 37 that are exposed to infrared or red light radiation and leaving the migration marking particles 28*a* charged in areas 35 not exposed to infrared or red light radiation. As shown in FIG. 7B, when layer 23 is situated above layer 26, and the charged member is subsequently imagewise exposed to infrared or red light radiation 31, absorption of the infrared or red light by layer 23 in the exposed areas results in photogeneration of electrons and holes which neutralize the positive surface charge and the negative charge in the migration marking particles.

In the embodiment illustrated in FIG. 7B, the resulting charge pattern is such that the imaging member cannot be developed by heat development, since there is no substantial electric field between the migration marking materials and the substrate. As shown schematically in FIG. 7C, the imaging member is further subjected to uniform recharging to a polarity opposite to that which the charge transport material in the softenable layer is capable of transporting (negative as illustrated in FIG. 7C), resulting in the migration marking material in areas of the imaging member which has not been exposed to infrared or red light radiation becoming negatively charged, with an electric field between the migration marking particles and the substrate, and areas of the imaging member previously exposed to infrared or red light radiation becoming charged only on the surface of the member. The charge image pattern obtained after the processes illustrated schematically in FIGS. 6A and 6B and FIGS. 7A, 7B, and 7C is thus identical to the one obtained after the processes illustrated schematically in FIGS. 4A and 4B and FIGS. 5A, 5B, and 5C.

Figure 8A:
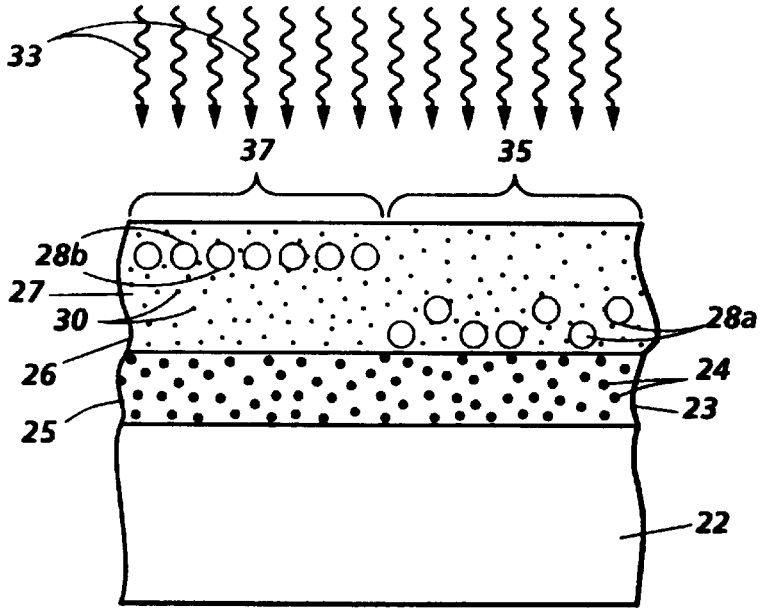
Figure 8B:
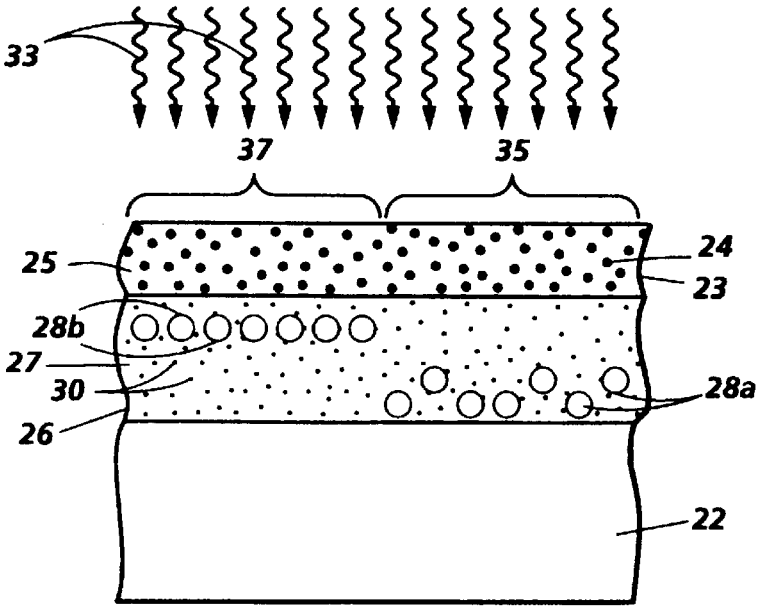

As illustrated schematically in FIGS. 8A and 8B, subsequent to formation of a charge image pattern, the imaging member is developed by causing the softenable materials to soften by any suitable means (in FIGS. 8A and 8B, by uniform application of heat energy 33 to the member). The heat development temperature and time depend upon factors such as how the heat energy is applied (e.g. conduction, radiation, convection, and the like), the melt viscosity of the softenable layer, thickness of the softenable layer, the amount of heat energy, and the like. For example, at a temperature of 110° C. to about 130° C., heat need only be applied for a few seconds. For lower temperatures, more heating time can be required. When the heat is applied, the softenable material 27 decreases in viscosity, thereby decreasing its resistance to migration of the marking material 28 through the softenable layer 26. As shown in FIG. 8A, when layer 26 is situated above layer 23, in areas 35 of the imaging member, wherein the migration marking material 28*a* has a substantial net charge, upon softening of the softenable material 27, the net charge causes the charged marking material to migrate in image configuration towards the conductive layer 22 and disperse or agglomerate in the softenable layer 26, resulting in a $D_{min}$ area. The uncharged migration marking particles 28*b* in areas 37 of the imaging member remain essentially neutral and uncharged. Thus, in the absence of migration force, the unexposed migration marking particles remain substantially in their original position in softenable layer 26, resulting in a $D_{max}$ area. As shown in FIG. 8B, in the embodiment wherein layer 23 is situated above layer 26 and the member was charged in step 3B to the same polarity as that which the charge transport material in the softenable layer is capable of transporting and in which the member has been recharged as shown in FIG. 5C or 7C to the polarity opposite to that which the charge transport material in the softenable layer is capable of transporting, the migration marking particles that are charged (those not exposed to infrared or red light radiation) migrate in depth toward the substrate 22 and disperse or agglomerate in softenable layer 26, resulting in a $D_{min}$ area. The uncharged migration marking particles 28*b* in areas 37 of the imaging member remain essentially neutral and uncharged. Thus, in the absence of migration force, the unexposed migration marking particles remain substantially in their original positions in softenable layer 26, resulting in a $D_{max}$ area.

If desired, solvent vapor development can be substituted for heat development. Vapor development of migration imaging members is well known in the art. Generally, if solvent vapor softening is utilized, the solvent vapor exposure time depends upon factors such as the solubility of the softenable layers in the solvent, the type of solvent vapor, the ambient temperature, the concentration of the solvent vapors, and the like.

The application of either heat, or solvent vapors, or combinations thereof, or any other suitable means should be sufficient to decrease the resistance of the softenable material 27 of softenable layer 26 to allow migration of the migration marking material 28 through softenable layer 26 in imagewise configuration. With heat development, satisfactory results can be achieved by heating the imaging member to a temperature of about 100° C. to about 130° C. for only a few seconds when the unovercoated softenable layer contains an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine. The test for a satisfactory combination of time and temperature is to maximize optical contrast density. With vapor development, satisfactory results can be achieved by exposing the imaging member to the vapor of toluene for between about 4 seconds and about 60 seconds at a solvent vapor partial pressure of between about 5 millimeters and 30 millimeters of mercury when the unovercoated softenable layer contains an 80/20 mole percent copolymer of styrene and hexylmethacrylate having an intrinsic viscosity of 0.179 dl/gm and N,N'-diphenyl-N,N'-bis(3"-methylphenyl)-(1,1'-biphenyl)-4,4'-diamine.

The imaging members illustrated in FIGS. 3A and 3B through 8A and 8B are shown without any optional layers such as those illustrated in FIGS. 1 and 2. If desired, alternative imaging member embodiments, such as those employing any or all of the optional layers illustrated in FIGS. 1 and 2, can also be employed.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

An infrared-sensitive migration imaging member was prepared as follows. A solution for the softenable layer was prepared by dissolving about 84 parts by weight of a terpolymer of styrene/ethylacrylate/acrylic acid (prepared as disclosed in U.S. Pat. No. 4,853,307, the disclosure of which is totally incorporated herein by reference) and about 16 parts by weight of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference) in about 450 parts by weight of toluene. N,N'-diphenyl-N,N'-bis(3"-methylphenyl)-(1,1'-biphenyl)-4,4'-diamine is a charge transport material capable of transporting positive charges (holes). The resulting solution was coated by a solvent extrusion technique onto a 3 mil thick polyester substrate (Melinex 442, obtained from Imperial Chemical Industries (ICI), aluminized to 50 percent light transmission), and the deposited softenable layer was allowed to dry at about 115° C. for about 2 minutes, resulting in a dried softenable layer with a thickness of about 2 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to 0.1 micron below the surface of the copolymer layer was formed.

The migration imaging member thus formed was then treated as follows. A pigment dispersion was prepared by ball milling for 24 hours a mixture comprising 10.6 parts by weight solids in a solvent (wherein the solvent comprised 40 percent by weight 2-propanol and 60 percent by weight deionized water), wherein the solids comprised 20 percent by weight X-metal-free phthalocyanine (prepared as described in U.S. Pat. No. 3,357,989 (Byrne et al.), the disclosure of which is totally incorporated by reference) and 80 percent by weight of a styrene-butyl methacrylate copolymer (ICI Neocryl A622). The resulting dispersion was hand coated onto the softenable layer of the migration imaging member with a #5 Meyer rod, followed by drying the deposited infrared-sensitive layer at 80° C. for 1 minute by contacting the polyester substrate to an aluminum heating block.

The infrared-sensitive migration imaging member thus prepared was imaged as follows. The surface of the member was uniformly positively charged to surface potential of +180 Volts with a corona charging device and was subsequently exposed by placing a test pattern mask comprising a silver halide image in contact with the imaging member and exposing the member to infrared light of 780 nanometers through the mask for a period of 20 seconds. The exposed member was subsequently uniformly exposed to light from a standard white fluorescent tube light for a period of 10 seconds through a filter comprising 2 layers of 3 mil thick polyester aluminized to 50 percent light transmission (obtained from ICI as Melinex, with the aluminized layers being employed to reduce the light energy striking the imaging member), and 10 layers each 1 micron thick comprising 35 percent by weight X-metal-free phthalocyanine and 65 percent by weight of a styrene-butyl methacrylate copolymer (ICI Neocryl A622) coated on 3 mil thick polyester (also obtained from ICI). Thereafter the exposed member was uniformly negatively recharged to a surface potential of −175 Volts with a corona charging device. The imaging member was then developed by subjecting it to a temperature of 100° C. for 5 seconds using a small aluminum heating block in contact with the polyester substrates. The optical density of the imaging member in the $D_{max}$ and $D_{min}$ areas was measured with a MacBeth TR927 densitometer in the blue region with a Wratten No. 47 filter, and the optical contrast density was 0.85 optical density units.

EXAMPLE II

An infrared-sensitive migration imaging member was prepared as follows. A solution for the softenable layer was prepared by dissolving about 84 parts by weight of a terpolymer of styrene/ethylacrylate/acrylic acid (prepared as disclosed in U.S. Pat. No. 4,853,307, the disclosure of which is totally incorporated herein by reference) and about 16 parts by weight of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference) in about 450 parts by weight of toluene. N,N'-diphenyl-N,N'-bis(3"-methylphenyl)-(1,1'-biphenyl)-4,4'-diamine is a charge transport material capable of transporting positive charges (holes). The resulting solution was coated by a solvent extrusion technique onto a 3 mil thick polyester substrate (Melinex 442, obtained from Imperial Chemical Industries (ICI), aluminized to 50 percent light transmission), and the deposited softenable layer was allowed to dry at about 115° C. for about 2 minutes, resulting in a dried softenable layer with a thickness of about 2 microns. The temperature of the softenable layer was then raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micron embedded about 0.05 to 0.1 micron below the surface of the copolymer layer was formed.

The migration imaging member thus formed was then treated as follows. A pigment dispersion was prepared by ball milling for 24 hours a mixture comprising 10.6 parts by weight solids in a solvent (wherein the solvent comprised 40 percent by weight 2-propanol and 60 percent by weight deionized water), wherein the solids comprised 20 percent by weight X-metal-free phthalocyanine (prepared as described in U.S. Pat. No. 3,357,989 (Byrne et al.), the disclosure of which is totally incorporated by reference) and 80 percent by weight of a styrene-butyl methacrylate copolymer (ICI Neocryl A622). The resulting dispersion was hand coated onto the softenable layer of the migration imaging member with a #5 Meyer rod, followed by drying the deposited infrared-sensitive layer at 80 ° C. for 1 minute by contacting the polyester substrate to an aluminum heating block.

The infrared-sensitive migration imaging member thus prepared was imaged as follows. The surface of the member was uniformly positively charged to a surface potential of +180 Volts with a corona charging device and was subsequently exposed by placing a test pattern mask comprising a silver halide image in contact with the imaging member and exposing the member to infrared light of 780 nanometers through the mask for a period of 20 seconds. The exposed member was subsequently uniformly exposed to light from a standard white fluorescent tube light for a period of 10 seconds through a filter #4445 having a broad bandpass of 350 nm to 600 nm. Thereafter the exposed member was uniformly negatively recharged to a surface potential of −175 Volts with a corona charging device. The imaging member was then developed by subjecting it to a temperature of 100° C. for 5 seconds using a small aluminum heating block in contact with the polyester substrates. The optical density of the imaging member in the $D_{max}$ and $D_{min}$ areas was measured with a MacBeth TR927 densitometer in the blue region with a Wratten No. 47 filter, and the optical contrast density was 0.68 optical density units. The broader bandpass filter reduced the optical contrast possible with the imaged film, compared to the optimized optical contrast obtained with the narrow bandpass filter employed in Example I.

EXAMPLE III

An infrared-sensitive migration imaging member was prepared as described in Example I. The member thus prepared was then imaged as follows. The member was incorporated into a modified ECRM ImageSetter Model VR45 and the surface of the member was uniformly positively charged to surface potential of +185 Volts with a corona charging device and subsequently exposed imagewise to infrared light at 780 nanometers (2540 dots per inch). The exposed member was then uniformly exposed to blue light from the luminous blue-green tube in the imagesetter having a broad peak wavelength at 490 nanometers. Exposure was through a filter comprising 12 layers each 1 micron thick comprising 35 percent by weight X-metal-free phthalocyanine and 65 percent by weight of a styrene-butyl methacrylate copolymer (ICI Neocryl A622). Thereafter the exposed member was uniformly negatively recharged to a surface potential of −179 Volts with a corona charging device. The imaging member was then developed with a single heated roller. Throughout the process, the imaging member was transported at a speed of 4.1 inches per minute. The optical density of the imaging member in the $D_{max}$ and $D_{min}$ areas was measured with a MacBeth TR927 densitometer in the blue region with a Wratten No. 47 filter, and the optical contrast density was 0.90 optical density units. The imaged member was of high resolution and high quality.

EXAMPLE IV

The process of Example I is repeated except that the infrared-sensitive migration imaging member is prepared as follows. Into 97.5 parts by weight of cyclohexanone (analytical reagent grade, available from British Drug House (BDH)) is dissolved 1.75 part by weight of Butvar B-72, a polyvinylbutyral resin (available from Monsanto Plastics & Resins Co.). To the solution is added 0.75 part by weight of X-metal free phthalocyanine (prepared as described in U.S. Pat. No. 3,357,989 (Byrne et al.), the disclosure of which is totally incorporated herein by reference) and 100 parts by weight of 118 inch diameter stainless steel balls. The dispersion (containing 2.5 percent by weight solids) is ball milled for 24 hours and then hand coated with a #4 wire wound rod onto a 4 mil thick conductive substrate comprising aluminized polyester (Melinex 442, available from Imperial Chemical Industries (ICI), aluminized to 20 percent light transmission). After the material is dried on the substrate at about 80° C. for about 20 seconds, the film thickness of the resulting pigment-containing layer is about 0.06 micron.

Thereafter a solution for the softenable layer is prepared by dissolving about 84 parts by weight of a terpolymer of styrene/ethylacrylate/acrylic acid (prepared as disclosed in U.S. Pat. No. 4,853,307, the disclosure of which is totally incorporated herein by reference) and about 16 parts by weight of N,N'-diphenyl-N,N'-bis(3"-methylphenyl)-(1,1'-biphenyl)-4,4'-diamine (prepared as disclosed in U.S. Pat. No. 4,265,990, the disclosure of which is totally incorporated herein by reference) in about 450 parts by weight of toluene. N,N'-diphenyl-N,N'-bis(3"-methylphenyl)-(1,1'-biphenyl)-4,4'-diamine is a charge transport material capable of transporting positive charges (holes). The resulting solution is coated by a solvent extrusion technique onto the infrared-sensitive pigment containing layer of the imaging member, and the deposited softenable layer is allowed to dry at about 115° C. for about 2 minutes, resulting in a dried softenable layer with a thickness of about 8 microns. The temperature of the softenable layer is then raised to about 115° C. to lower the viscosity of the exposed surface of the softenable layer to about $5\times10^3$ poises in preparation for the deposition of marking material. A thin layer of particulate vitreous selenium is then applied by vacuum deposition in a vacuum chamber maintained at a vacuum of about $4\times10^{-4}$ Torr. The imaging member is then rapidly chilled to room temperature. A reddish monolayer of selenium particles having an average diameter of about 0.3 micron embedded about 0.05 to 0.1 micron below the surface of the copolymer layer is formed.

It is believed that results substantially similar to those of Example I will be obtained.

EXAMPLE V

The process of Example III is repeated except that the infrared-sensitive migration imaging member is prepared as described in Example IV. It is believed that results substantially similar to those of Example III will be obtained.

Other embodiments and modifications of the present invention may occur to those skilled in the art subsequent to a review of the information presented herein; these embodiments and modifications, as well as equivalents thereof, are also included within the scope of this invention.

What is claimed is:

1. A process which comprises (a) providing a migration imaging member comprising (1) a substrate, (2) an infrared or red light radiation sensitive layer comprising a pigment predominantly sensitive to infrared or red light radiation, and (3) a softenable layer comprising a softenable material, a charge transport material, and a photosensitive migration marking material predominantly sensitive to radiation at a wavelength other than that to which the infrared or red light sensitive pigment is predominantly sensitive; (b) uniformly charging the imaging member; (c) subsequent to step (b), uniformly exposing the charged imaging member to a source of activating radiation with a wavelength to which the migration marking material is sensitive, wherein a filter comprising the infrared or red light radiation sensitive pigment is situated between the radiation source and the imaging member; (d) subsequent to step (b), exposing the imaging member to infrared or red light radiation at a wavelength to which the infrared or red light radiation sensitive pigment is sensitive in an imagewise pattern, thereby forming an electrostatic latent image on the imaging member; and (e) subsequent to steps (c) and (d), causing the softenable material to soften, thereby enabling the migration marking material to migrate through the softenable material toward the substrate in an imagewise pattern.

2. A process according to claim 1 wherein the migration marking material is selected from the group consisting of (a) selenium, (b) tellurium, (c) alloys of selenium and a material selected from the group consisting of tellurium, arsenic, antimony, thallium, bismuth, or mixtures thereof, (d) alloys of tellurium and a material selected from the group consisting of arsenic, antimony, thallium, bismuth, or mixtures thereof, (e) halogen doped selenium, (f) halogen doped tellurium, (g) halogen doped alloys of selenium and a material selected from the group consisting of tellurium, arsenic, antimony, thallium, bismuth, or mixtures thereof, (h) halogen doped alloys of tellurium and a material selected from the group consisting of arsenic, antimony, thallium, bismuth, or mixtures thereof, and (i) mixtures thereof.

3. A process according to claim 1 wherein the migration marking material is selenium.

4. A process according to claim 1 wherein the infrared or red light radiation sensitive layer is situated between the substrate and the softenable layer.

5. A process according to claim 1 wherein the softenable layer is situated between the substrate and the infrared or red light radiation sensitive layer.

6. A process according to claim 1 wherein the pigment sensitive to infrared or red light radiation is selected from the group consisting of benzimidazole perylene, dibromoanthranthrone, trigonal selenium, beta-metal free phthalocyanine, X-metal free phthalocyanine, vanadyl phthalocyanine, chloroindium phthalocyanine, titanyl phthalocyanine, chloroaluminum phthalocyanine, copper phthalocyanine, magnesium phthalocyanine, and mixtures thereof.

7. A process according to claim 1 wherein the pigment sensitive to infrared or red light radiation is X-metal free phthalocyanine.

8. A process according to claim 1 wherein the migration marking material is selenium and the pigment sensitive to infrared or red light radiation is X-metal free phthalocyanine.

9. A process according to claim 1 wherein the filter comprises a substrate and a layer coated thereon containing the infrared or red light radiation sensitive pigment.

10. A process according to claim 1 wherein the filter comprises the infrared or red light radiation sensitive pigment and a binder.

11. A process according to claim 10 wherein the binder is present in an amount of from about 5 to about 95 percent by weight and the infrared or red light radiation sensitive pigment is present in an amount of from about 5 to about 95 percent by weight.

12. A process according to claim 10 wherein the binder is present in an amount of from about 40 to about 90 percent by weight and the infrared or red light radiation sensitive pigment is present in an amount of from about 10 to about 60 percent by weight.

13. A process according to claim 10 wherein the total thickness of layers containing the binder and the infrared or red light radiation sensitive pigment is from about 0.5 to about 25 microns.

14. A process according to claim 10 wherein the total thickness of layers containing the binder and the infrared or red light radiation sensitive pigment is from about 1 to about 20 microns.

15. A process according to claim 1 wherein the filter has a bandwidth of about ±50 nanometers of a selected central wavelength value, wherein light at wavelengths of more than about 50 nanometers greater than the central wavelength value and wavelengths of less than about 50 nanometers less than the central wavelength value passes through the filter at an intensity of about 50 percent transmission or less of the intensity of light passing through the filter at the central wavelength value.

16. A process according to claim 1 wherein the filter has a bandwidth of about ±40 nanometers of a selected central wavelength value, wherein light at wavelengths of more than about 40 nanometers greater than the central wavelength value and wavelengths of less than about 40 nanometers less than the central wavelength value passes through the filter at an intensity of about 50 percent transmission or less of the intensity of light passing through the filter at the central wavelength value.

17. A process according to claim 1 wherein the filter has a bandwidth of about ±30 nanometers of a selected central wavelength value, wherein light at wavelengths of more than about 30 nanometers greater than the central wavelength value and wavelengths of less than about 30 nanometers less than the central wavelength value passes through the filter at an intensity of about 50 percent transmission or less of the intensity of light passing through the filter at the central wavelength value.

18. A process according to claim 1 wherein the filter has a bandwidth of about ±50 nanometers of a selected central wavelength value, wherein light at wavelengths of more than about 50 nanometers greater than the central wavelength value and wavelengths of less than about 50 nanometers less than the central wavelength value passes through the filter at an intensity of about 25 percent transmission or less of the intensity of light passing through the filter at the central wavelength value.

19. A process according to claim 1 wherein the filter has a bandwidth of about ±40 nanometers of a selected central wavelength value, wherein light at wavelengths of more than about 40 nanometers greater than the central wavelength value and wavelengths of less than about 40 nanometers less than the central wavelength value passes through the filter at an intensity of about 25 percent transmission or less of the intensity of light passing through the filter at the central wavelength value.

20. A process according to claim 1 wherein the filter has a bandwidth of about ±30 nanometers of a selected central wavelength value, wherein light at wavelengths of more than about 30 nanometers greater than the central wavelength value and wavelengths of less than about 30 nanometers less than the central wavelength value passes through the filter at an intensity of about 25 percent transmission or less of the intensity of light passing through the filter at the central wavelength value.

21. A process according to claim 1 wherein the filter has a bandwidth of about ±50 nanometers of a selected central wavelength value, wherein light at wavelengths of more than about 50 nanometers greater than the central wavelength value and wavelengths of less than about 50 nanometers less than the central wavelength value passes through the filter at an intensity of about 17 percent transmission or less of the intensity of light passing through the filter at the central wavelength value.

22. A process according to claim 1 wherein the filter has a bandwidth of about ±40 nanometers of a selected central wavelength value, wherein light at wavelengths of more than about 40 nanometers greater than the central wavelength value and wavelengths of less than about 40 nanometers less than the central wavelength value passes through the filter at an intensity of about 17 percent transmission or less of the intensity of light passing through the filter at the central wavelength value.

23. A process according to claim 1 wherein the filter has a bandwidth of about ±30 nanometers of a selected central wavelength value, wherein light at wavelengths of more than about 30 nanometers greater than the central wavelength value and wavelengths of less than about 30 nanometers less than the central wavelength value passes through the filter at an intensity of about 17 percent transmission or less of the intensity of light passing through the filter at the central wavelength value.

24. A process according to claim 1 wherein the filter has a bandwidth of about ±50 nanometers of a central wavelength value of 490 nanometers, wherein light at wavelengths of more than about 540 nanometers and wavelengths of less than about 440 nanometers less than the central wavelength value passes through the filter at an intensity of about 50 percent transmission or less of the intensity of light passing through the filter at the central wavelength value.

25. A process according to claim 1 wherein the filter has a bandwidth of about ±40 nanometers of a central wavelength value of 490 nanometers, wherein light at wavelengths of more than about 530 nanometers and wavelengths of less than about 450 nanometers less than the central wavelength value passes through the filter at an intensity of about 50 percent transmission or less of the intensity of light passing through the filter at the central wavelength value.

26. A process according to claim 1 wherein the filter has a bandwidth of about ±30 nanometers of a central wavelength value of 490 nanometers, wherein light at wavelengths of more than about 520 nanometers and wavelengths of less than about 460 nanometers less than the central wavelength value passes through the filter at an intensity of about 50 percent transmission or less of the intensity of light passing through the filter at the central wavelength value.

27. A process according to claim 1 wherein the filter has a bandwidth of about ±50 nanometers of a central wavelength value of 490 nanometers, wherein light at wavelengths of more than about 540 nanometers and wavelengths of less than about 440 nanometers less than the central wavelength value passes through the filter at an intensity of about 25 percent transmission or less of the intensity of light passing through the filter at the central wavelength value.

28. A process according to claim 1 wherein the filter has a bandwidth of about ±40 nanometers of a central wavelength value of 490 nanometers, wherein light at wavelengths of more than about 530 nanometers and wavelengths of less than about 450 nanometers less than the central wavelength value passes through the filter at an intensity of about 25 percent transmission or less of the intensity of light passing through the filter at the central wavelength value.

29. A process according to claim 1 wherein the filter has a bandwidth of about ±30 nanometers of a central wavelength value of 490 nanometers, wherein light at wavelengths of more than about 520 nanometers and wavelengths of less than about 460 nanometers less than the central wavelength value passes through the filter at an intensity of about 25 percent transmission or less of the intensity of light passing through the filter at the central wavelength value.

30. A process according to claim 1 wherein the filter has a bandwidth of about ±50 nanometers of a central wavelength value of 490 nanometers, wherein light at wavelengths of more than about 540 nanometers and wavelengths of less than about 440 nanometers less than the central wavelength value passes through the filter at an intensity of about 17 percent transmission or less of the intensity of light passing through the filter at the central wavelength value.

31. A process according to claim 1 wherein the filter has a bandwidth of about ±40 nanometers of a central wavelength value of 490 nanometers, wherein light at wavelengths of more than about 530 nanometers and wavelengths of less than about 450 nanometers less than the central wavelength value passes through the filter at an intensity of about 17 percent transmission or less of the intensity of light passing through the filter at the central wavelength value.

32. A process according to claim 1 wherein the filter has a bandwidth of about ±30 nanometers of a central wavelength value of 490 nanometers, wherein light at wavelengths of more than about 520 nanometers and wavelengths of less than about 460 nanometers less than the central wavelength value passes through the filter at an intensity of about 17 percent transmission or less of the intensity of light passing through the filter at the central wavelength value.

* * * * *